US009195204B2

(12) United States Patent
Ishizuka et al.

(10) Patent No.: US 9,195,204 B2
(45) Date of Patent: Nov. 24, 2015

(54) IMAGE FORMING APPARATUS

(71) Applicants: Yusuke Ishizuka, Kanagawa (JP); Hirotaka Hatta, Kanagawa (JP); Toshiya Sato, Kanagawa (JP); Akira Asaoka, Kanagawa (JP); Norio Kudo, Kanagawa (JP); Hiroyuki Uenishi, Kanagawa (JP); Kenji Sugiura, Kanagawa (JP); Kazuki Yogosawa, Tokyo (JP)

(72) Inventors: Yusuke Ishizuka, Kanagawa (JP); Hirotaka Hatta, Kanagawa (JP); Toshiya Sato, Kanagawa (JP); Akira Asaoka, Kanagawa (JP); Norio Kudo, Kanagawa (JP); Hiroyuki Uenishi, Kanagawa (JP); Kenji Sugiura, Kanagawa (JP); Kazuki Yogosawa, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/254,006

(22) Filed: Apr. 16, 2014

(65) Prior Publication Data

US 2014/0314461 A1 Oct. 23, 2014

(30) Foreign Application Priority Data

Apr. 19, 2013 (JP) ..... 2013-088901

(51) Int. Cl.

| | |
|---|---|
| ***G03G 15/00*** | (2006.01) |
| ***G03G 21/00*** | (2006.01) |
| ***G03G 15/16*** | (2006.01) |
| ***G03G 21/10*** | (2006.01) |

(52) U.S. Cl.

CPC ..... *G03G 21/0035* (2013.01); *G03G 15/161* (2013.01); *G03G 21/105* (2013.01); *G03G 2215/1661* (2013.01)

(58) Field of Classification Search

CPC ..... G03G 21/0035; G03G 21/007; G03G 15/161; G03G 21/105; G03G 2215/1661

USPC ..... 399/71, 101, 123, 343, 358

See application file for complete search history.

(56) References Cited

U.S. PATENT DOCUMENTS

| | | | | |
|---|---|---|---|---|
| 2009/0003865 | A1* | 1/2009 | Endou et al. | 399/66 |
| 2010/0119270 | A1* | 5/2010 | Hoshino et al. | 399/358 |
| 2011/0103822 | A1 | 5/2011 | Sugiura et al. | |
| 2011/0158677 | A1 | 6/2011 | Kikuchi et al. | |
| 2011/0229187 | A1 | 9/2011 | Hozumi et al. | |

(Continued)

FOREIGN PATENT DOCUMENTS

| | | |
|---|---|---|
| JP | 2001-147629 | 5/2001 |

OTHER PUBLICATIONS

U.S. Appl. No. 14/541,279, filed Nov. 14, 2014.

*Primary Examiner* — Walter L Lindsay, Jr.
*Assistant Examiner* — Jessica L Eley
(74) *Attorney, Agent, or Firm* — Oblon, McClelland, Maier & Neustadt, L.L.P.

(57) ABSTRACT

An image forming apparatus includes an image carrier, a toner-image forming unit, a transfer unit, a cleaner, a plurality of cylindrical transport path forming members, a falling transport path forming member, and a discharge port. The falling transport path forming member has through holes in a side wall thereof. A second end of each of the transport path forming members is inserted into a corresponding one of the through holes. The falling transport path forming member forms a falling transport path that causes toner ejected from an ejection port disposed in the second end to fall. The discharge port is disposed in a lower part of the falling transport path forming member to discharge the toner to a discharge destination. The second ends of the transport path forming members are disposed offset from each other in a horizontal direction on the side wall of the falling transport path forming member.

18 Claims, 12 Drawing Sheets

(56) References Cited

U.S. PATENT DOCUMENTS

| | | | | |
|---|---|---|---|---|
| 2011/0229234 | A1 | 9/2011 | Hozumi et al. | |
| 2011/0318049 | A1* | 12/2011 | Suzuki | 399/101 |
| 2012/0008973 | A1 | 1/2012 | Sakakibara et al. | |
| 2012/0034006 | A1* | 2/2012 | Asaoka et al. | 399/343 |
| 2012/0087704 | A1 | 4/2012 | Asaoka et al. | |
| 2012/0099883 | A1 | 4/2012 | Kikuchi et al. | |
| 2012/0224870 | A1 | 9/2012 | Kikuchi et al. | |
| 2013/0315617 | A1 | 11/2013 | Sugiura et al. | |
| 2014/0064769 | A1 | 3/2014 | Sugiura | |
| 2014/0321874 | A1 | 10/2014 | Sugiura et al. | |

* cited by examiner

IMAGE FORMING APPARATUS

CROSS-REFERENCE TO RELATED APPLICATIONS

This patent application is based on and claims priority pursuant to 35 U.S.C. §119 to Japanese Patent Application No. 2013-088901, filed on Apr. 19, 2013, in the Japan Patent Office, the entire disclosure of which is hereby incorporated by reference herein.

BACKGROUND

1. Technical Field

Exemplary embodiments of this disclosure relate to an image forming apparatus such as a printer, a facsimile, or a copying machine.

2. Description of the Related Art

Image forming apparatuses are used as, for example, copiers, printers, facsimile machines, and multi-functional devices having at least one of the foregoing capabilities. As one type of image forming apparatus, electrophotographic image forming apparatuses are known. As a conventional image forming apparatus of this type, an image forming apparatus described in JP-2001-147629-A (JP-3893232-B) is known. The image forming apparatus brings a transfer roller into contact with a photoconductor to form a transfer nip. A toner image formed on a surface of the photoconductor is transferred onto a recording sheet nipped in a transfer nip. Some amount of residual toner which has not been transferred onto the recording sheet may adhere to the surface of the photoconductor that has passed through the transfer nip. The residual toner is removed from the photoconductor surface with a cleaning device.

The cleaning device is configured such that a cleaning blade disposed in contact with the surface of the photoconductor is stored in a cleaning case and the cleaning blade scrapes residual toner after transfer from the photoconductor surface to collect the toner in the cleaning case. The toner collected from the photoconductor surface with the cleaning device, to be discarded or recycled, is transported with a toner transport device into a collected toner container disposed in a body of the image forming apparatus independently of the cleaning device.

The toner transport device disposed in the image forming apparatus described in JP-2001-147629-A has a transport housing that forms a falling transport path that is disposed in such a posture that it extends in a vertical direction to cause toner to fall by its own weight so as to transfer the toner. A through hole that communicates with the inside and the outside of a side wall with each other is formed in the side wall of the transport housing, and one end of a toner transport pipe to transport toner collected from the photoconductor surface with the cleaning blade is inserted into the through hole. The other end of the toner transport pipe is connected to the cleaning case to communicate with a discharge port formed in the cleaning case.

With the rotation of a transport screw rotatably disposed in the toner transport pipe, the toner is ejected from an ejection port formed in the end face of the one end from the inside of the cleaning case through the toner transport pipe and sent to the falling transport path in the transport housing. The toner sent to the falling transport path is transported by gravity falling in the falling transport path and finally transported into the collected toner container.

In the image forming apparatus described in JP-2001-147629-A, only one toner transport pipe is used to transport the toner collected from the photoconductor surface from the cleaning case to the falling transport path of the transport housing. However, in order to improve toner transport capability, a plurality of toner transport pipes may be disposed.

In this case, a plurality of through holes are formed in the side wall of the transport housing, the ends of the plurality of toner transport pipes are inserted into the through holes, respectively, the plurality of toner transport pipes are connected to a single falling transport path to integrate the transport paths into one, and the toner is transported into the collected toner container. In this manner, the configuration of a toner transport device can be made simple more than that obtained when falling transport paths are independently disposed for a plurality of toner transport pipes, respectively.

However, when the ends of the plurality of toner transport pipes are disposed by being inserted into the plurality of through holes formed in the transport housing, depending on the positional relationship between the toner transport pipes, toner ejected from the ejection port of one toner transport pipe is accumulated on the outer circumferential surface of another toner transport pipe. In this manner, when the toner is accumulated on the outer circumferential surface of the toner transport pipe, the accumulated toner is agglomerated and gradually grown to gradually narrow down the falling transport path so as to form a toner bridge, and the toner bridge blocks toner transport.

The above-described problem relates to toner transportation from the cleaning device for cleaning the photoconductor. However, a similar problem may be posed in a configuration of cleaning the intermediate transfer belt.

BRIEF SUMMARY

In at least one exemplary embodiment of this disclosure, there is provided an image forming apparatus including an image carrier, a toner-image forming unit, a transfer unit, a cleaner, a plurality of cylindrical transport path forming members, a falling transport path forming member, and a discharge port. The toner-image forming unit forms a toner image on a surface of the image carrier. The transfer unit transfers the toner image formed on the surface of the image carrier to a transfer material. The cleaner removes toner adhering to and remaining on the surface of the image carrier after the toner image is transferred by the transfer unit. Each of the plurality of cylindrical transport path forming members forms a transport path to transport the toner removed by the cleaner and has a first end connected to the cleaner. The falling transport path forming member has through holes in a side wall of the falling transport path forming member. A second end of each of the plurality of transport path forming members is inserted into a corresponding one of the through holes. The falling transport path forming member forms a falling transport path that causes toner ejected from an ejection port disposed in the second end of each of the plurality of transport path forming members to fall. The discharge port is disposed in a lower part of the falling transport path forming member to discharge the toner to a discharge destination. The second ends of the plurality of transport path forming members are disposed offset from each other in a horizontal direction on the side wall of the falling transport path forming member.

BRIEF DESCRIPTION OF THE DRAWINGS

The aforementioned and other aspects, features, and advantages of the present disclosure would be better understood by reference to the following detailed description when considered in connection with the accompanying drawings, wherein.

Figure 1:
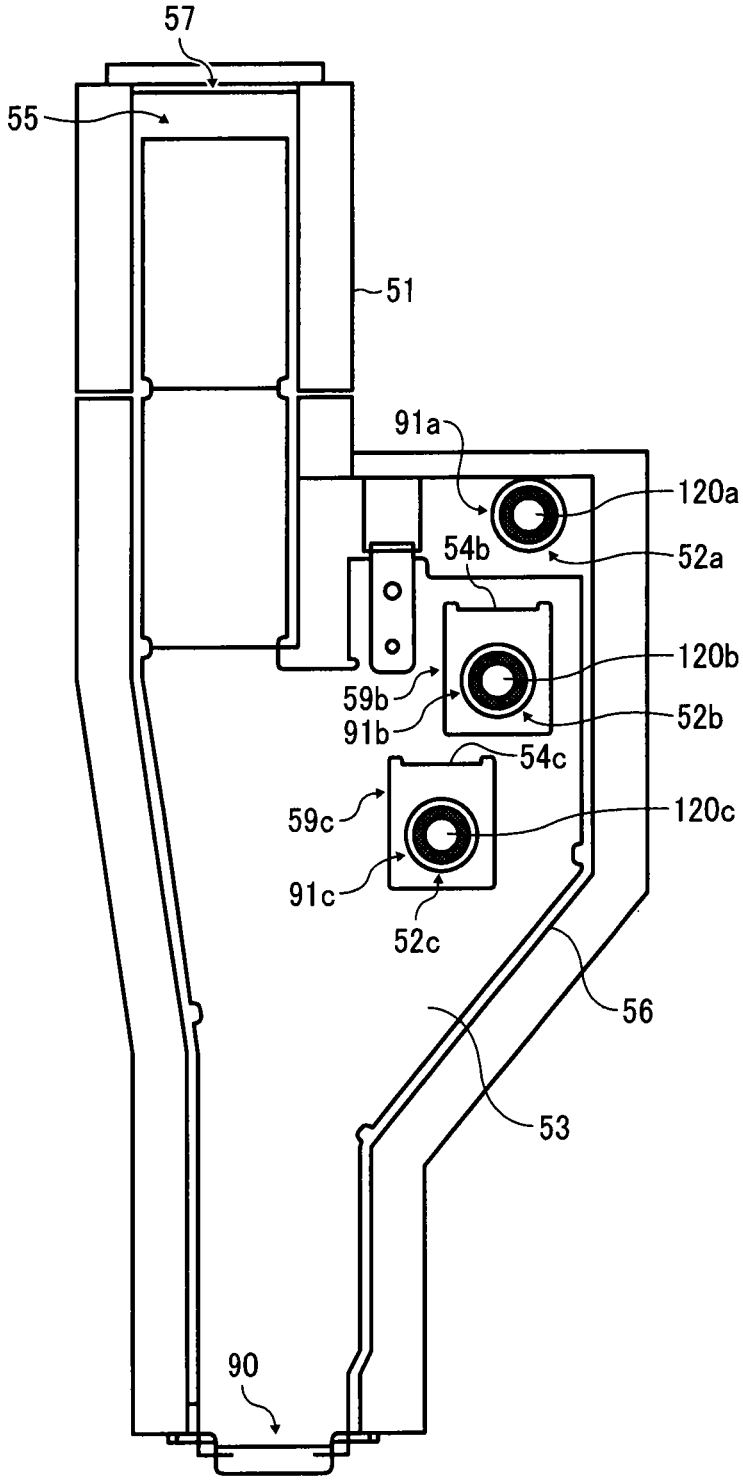
FIG. 1 is a front view of a discharged-matter transport unit.

The accompanying drawings are intended to depict exemplary embodiments of the present disclosure and should not be interpreted to limit the scope thereof. The accompanying drawings are not to be considered as drawn to scale unless explicitly noted.

DETAILED DESCRIPTION OF EXEMPLARY EMBODIMENTS

In describing embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner and achieve similar results.

Although the exemplary embodiments are described with technical limitations with reference to the attached drawings, such description is not intended to limit the scope of the disclosure and all of the components or elements described in the exemplary embodiments of this disclosure are not necessarily indispensable.

Referring now to the drawings, exemplary embodiments of the present disclosure are described below. In the drawings for explaining the following exemplary embodiments, the same reference codes are allocated to elements (members or components) having the same function or shape and redundant descriptions thereof are omitted below.

A so-called intermediate-transfer-tandem image printer (to be simply referred to as a printer hereinafter) is described below as an image forming apparatus according to an embodiment of this disclosure. However, the image forming apparatus is not limited to the intermediate-transfer-tandem image printer and may be any other suitable type of image forming apparatus.

First, a basic configuration of the printer according to this embodiment is described below.

Figure 2:
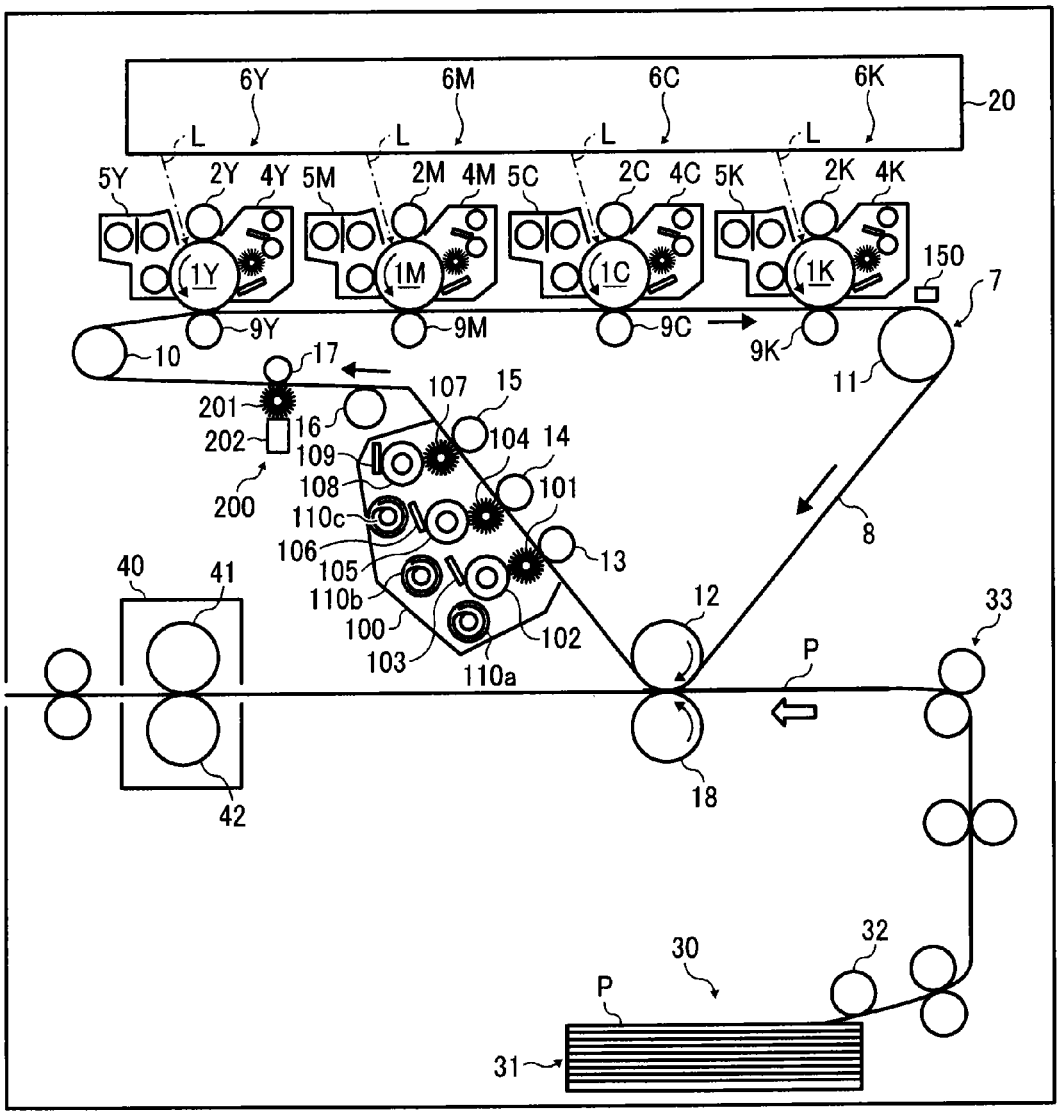
FIG. 2 is a schematic view of a configuration of a part of a printer according to an embodiment of this disclosure.

FIG. 2 is a schematic view of a configuration of a part of the printer according to this embodiment. The printer includes four process units 6Y, 6M, 6C, and 6K to form toner images in yellow, magenta, cyan, and black (to be referred to as Y, M, C, and K hereinafter).

The four process units 6Y, 6M, 6C, and 6K have drum-like photoconductors 1Y, 1M, 1C, and 1K, respectively. The photoconductors 1Y, 1M, 1C, and 1K have charging devices 2Y, 2M, 2C, and 2K, development devices 5Y, 5M, 5C, and 5K, drum cleaning devices 4Y, 4M, 4C, and 4K, neutralizing devices, and the like therearound, respectively.

The process units 6Y, 6M, 6C, and 6K use Y, M, C, and K toners having colors different from each other, but have the same configurations, respectively. Above the process units 6Y, 6M, 6C, and 6K, an optical writing unit 20 to irradiate a laser beam L on the surfaces of the photoconductors 1Y, 1M, 1C, and 1K to write electrostatic latent images is disposed.

Below the process units 6Y, 6M, 6C, and 6K, a transfer unit 7 serving as a belt device including an endless intermediate transfer belt 8 serving as a belt member is disposed. The transfer unit 7 includes, in addition to the intermediate transfer belt 8, a plurality of extension rollers disposed inside the loop of the belt, a secondary transfer roller 18 disposed outside the loop, a tension roller 16, a belt cleaning device 100, a lubricant application device 200, and the like.

Inside the loop of the intermediate transfer belt 8, four primary transfer rollers 9Y, 9M, 9C, and 9K, a driven roller 10, a driving roller 11, a secondary-transfer opposed roller 12, three cleaning opposed rollers 13, 14, and 15, and an applying brush opposed roller 17 are disposed. Each of all the rollers functions as an extension roller having a peripheral surface on which the intermediate transfer belt 8 is partially hung to extend the belt.

As a necessary condition of the cleaning opposed rollers 13, 14, and 15, the cleaning opposed rollers 13, 14, and 15 need not necessarily give a predetermined tension to the belt. The cleaning opposed rollers 13, 14, and 15 may be driven and rotated with the rotation of the intermediate transfer belt 8.

The intermediate transfer belt 8 is endlessly moved in the counterclockwise direction in FIG. 2 with the rotation of the driving roller 11 rotationally driven in the counterclockwise direction in FIG. 2 by a driving unit.

The four primary transfer rollers 9Y, 9M, 9C, and 9K disposed inside the belt loop sandwich the intermediate transfer belt 8 between the primary transfer rollers 9Y, 9M, 9C, and 9K and the photoconductors 1Y, 1M, 1C, and 1K. In this manner, primary transfer nips for Y, M, C, and K on which the front surface of the intermediate transfer belt 8 is brought into contact with the photoconductors 1Y, 1M, 1C, and 1K are formed. Primary transfer biases each having a polarity opposite that of toner are applied to the primary transfer rollers 9Y, 9M, 9C, and 9K with power supplies, respectively.

The secondary-transfer opposed roller 12 disposed inside the belt loop sandwiches the intermediate transfer belt 8 between the secondary-transfer opposed roller 12 and a secondary transfer roller 18 disposed outside the belt loop. In this manner, a secondary transfer nip on which the front surface of the intermediate transfer belt 8 is brought into contact with the secondary transfer roller 18 is formed. A secondary transfer bias having a polarity opposite that of toner is applied to the secondary transfer roller 18 with a power supply. A sheet conveyance belt may be bridged by a secondary transfer roller, several support rollers, and a driving roller, and the intermediate transfer belt 8 and the sheet conveyance belt may be sandwiched between the secondary transfer roller 18 and the secondary-transfer opposed roller 12.

The three cleaning opposed rollers 13, 14, and 15 disposed inside the belt loop sandwich the intermediate transfer belt 8 between the cleaning opposed rollers 13, 14, and 15 and cleaning brush rollers 101, 104, and 107 of a belt cleaning device 100 disposed outside the belt loop. In this manner, a cleaning nip on which the front surface of the intermediate transfer belt 8 is brought into contact with the cleaning brush rollers 101, 104, and 107 is formed.

The belt cleaning device 100 is replaceable together with the intermediate transfer belt 8. However, when the belt cleaning device 100 and the intermediate transfer belt 8 have different lifetimes, the belt cleaning device 100 may be attachable and detachable to/from the printer body independently of the intermediate transfer belt 8. The belt cleaning device 100 will be described in detail below.

The printer according to this embodiment includes a sheet feed section 30 having a sheet feed tray 31 that stores a recording sheet P serving as a transfer material, a sheet feed roller 32 that feeds the recording sheet P from the sheet feed tray 31 to the sheet feed path, and the like. A pair of registration rollers 33 that receives the recording sheet P sent from the sheet feed section 30 and sends the recording sheet P toward the secondary transfer nip at a predetermined timing is disposed on the right side of the secondary transfer nip described above in FIG. 2.

A fixing device 40 that receives the recording sheet P sent from the secondary transfer nip, performs a fixing process of a toner image on the recording sheet P, and has a heating roller 41 and a pressing roller 42 is disposed on the left of the secondary transfer nip in FIG. 2. As needed, toner supply devices for Y, M, C, and K that supply Y, M, C, and K toners to the development devices 5Y, 5M, 5C, and 5K are also disposed.

In recent years, the frequency of use of, in addition to a regular sheet that has been conventionally and widely used as a recording sheet, a special sheet designed to have uneven surfaces or a special recording sheet used for thermal transfer such as ironing print has been increased. When the special sheet is used, in comparison with in use of a conventional regular sheet, defective transfer is likely to occur when a toner image on the intermediate transfer belt 8 obtained by overlapping color toner images is secondarily transferred onto a sheet.

Hence, in the printer, an elastic layer having low hardness is formed on the intermediate transfer belt 8, so that the intermediate transfer belt 8 can be transformed for the toner layer or a recording sheet having poor smoothness at the transfer nipping portion. The elastic layer having low hardness is formed on the intermediate transfer belt 8 to make the intermediate transfer belt 8 elastic, so that the surface of the intermediate transfer belt 8 can be transformed in accordance with local irregularity. In this manner, good tightness can be achieved without excessively increasing a transfer pressure on the toner layer, character missing in transfer does not occur, and a uniform transferred image in which uneven transfer does not occur on a sheet or the like having poor smoothness can be obtained.

In the printer, the intermediate transfer belt 8 includes at least a base layer, an elastic layer, and a coat layer serving as the uppermost layer.

As a material used in the elastic layer of the intermediate transfer belt 8, an elastic member such as an elastic material rubber or an elastomer is given.

More specifically, one or more selected from the group consisting of isobutylene-isoprene rubber, fluororubber, acrylic rubber, ethylene propylene diene monomer (EPDM), nitrile rubber (NBR), acrylonitrile-butadiene-styrene rubber, natural rubber, isoprene rubber, styrene-butadiene rubber, butadiene rubber, polyurethane rubber, syndiotactic 1,2-polybutadiene, epichlorohydrin rubber, polysulfide rubber, polynorbornene rubber, and thermoplastic elastomer (for example, polystyrene resin, polyolefin resin, polyvinyl chloride resin, polyurethane resin, polyamide resin, polyurea resin, polyester resin, and fluorine resin) can be used. However, the material used in the elastic layer is not limited to the above materials.

The thickness of the elastic layer, depending on a hardness and a layer configuration, preferably ranges from 0.07 mm to 0.8 mm. More preferably, the thickness ranges from 0.25 mm to 0.5 mm. When the thickness of the intermediate transfer belt 8 is small, i.e., 0.07 mm or less, a pressure on toner on the intermediate transfer belt 8 at the secondary transfer nip becomes high, character missing in transfer is likely to occur, and a transfer ratio of toner decreases.

The hardness of the elastic layer preferably falls within a range given by $10° \leq HS \leq 65°$ (JIS-A). Although an optimum hardness changes depending on the layer thickness of the intermediate transfer belt 8, when the hardness is lower than 10° JIS-A, character missing in transfer is likely to occur. By contrast, when the hardness is higher than 65° JIS-A, the intermediate transfer belt 8 is difficult to stretch between the roller, and the intermediate transfer belt 8 extends due to long-term stretching to lose the durability. As a result, the intermediate transfer belt 8 need to be early exchanged.

The base layer of the intermediate transfer belt 8 is made of a resin having low elongation. More specifically, as a material used in a base layer, one or more selected from a group consisting of styrene resin (single polymer including styrene or a styrene substitute or copolymer) such as polycarbonate, fluoro resin (ethylene tetrafluoroethylene (ETFE), polyvinylidene difluoride (PVDF), or the like), polystyrene, chloropolystyrene, poly-a-methyl styrene, styrene-butadiene copolymer, styrene-vinyl chloride copolymer, styrene-vinyl acetate copolymer, styrene-maleic acid copolymer, styrene-acrylic ester copolymer (styrene-acrylic acid methyl copolymer, styrene-acrylic acid ethyl copolymer, styrene-acrylic acid butyl copolymer, styrene-acrylic acid octyl copolymer, styrene-acrylic acid phenyl copolymer, or the like), styrene-methacrylic acid ester copolymer (styrene-methyl methacrylate copolymer, styrene-methacrylic acid ethyl copolymer, styrene-methacrylic acid phenyl copolymer, or the like), styrene-a-chlor acrylic acid methyl copolymer, styrene-acrylonitrile-acrylic ester copolymer, methyl methacrylate resin, methacrylate butyl resin, acrylic acid ethyl resin, acrylic acid butyl resin, denaturing acrylic acid resin (silicone denaturation acrylic acid resin, vinyl chloride resin denaturation acrylic acid resin, acrylic urethane resin, or the like), vinyl chloride resin, styrene-vinyl acetate copolymer, vinyl chloride-vinyl acetate copolymer, rosin-modified maleic acid resin, phenolic resin, epoxy resin, polyester resin, polyester polyurethane resin, polyethylene, polypropylene, polybutadiene, polyvinylidene chloride, an ionomer resin, polyurethane resin, silicone resin, ketone resin, ethylene-ethyl acrylate copolymer, xylene resin and polyvinyl butyral resin, polyamide resin, modified polyphenylene oxide resin, and the like can be used. However, the material used in a base layer is not limited to the above materials.

In order to prevent elongation of the elastic layer made of a rubber material or the like having high elongation, a core layer made of a material such as canvas or the like may be disposed between the base layer and the elastic layer.

As a material that is used in the core layer to prevent elongation of the core layer, for example, one or more selected from the group consisting of a natural fiber such cotton or silk, a synthetic fiber such as a polyester fiber, a nylon fiber, an acrylic fiber, a polyolefin fiber, a polyvinyl alcohol fiber, a polychlorinated vinyl fiber, a polyvinylidene chloride fiber, a polyurethane fiber, a polyacetal fiber, a polyphloroethylene fiber, or a phenol fiber, an inorganic fiber such as a carbon fiber or a glass fiber, and a metal fiber such as an iron fiber or a copper fiber are used, and a fiber in the form of a thread or a woven cloth can be used. However, the material to prevent the elongation is not limited to the above materials.

The thread may be one filament or obtained by twisting a plurality of filaments. A thread such as a single twist yarn, a plied yarn, or a two folded yarn that is twisted by any twisting method may be used. Fibers of materials selected from the material group described above may be blended. As a matter of course, a thread applied with an appropriate process to have electrical conductivity may be used. On the other hand, as a woven fabric, a woven fabric such as a knitted fabric that is woven by any weave can be used. As a matter of course, a woven fabric obtained by combined weaving can also be used, and can also be applied with a process to have electrical conductivity.

The coat layer on the surface of the intermediate transfer belt coats the surface of the elastic layer, and is constituted of a smooth layer. A material used in the coat layer is not limited to a specific one. However, in general, a material that reduces adherence of toner to the surface of the intermediate transfer belt 8 to improve secondary transfer properties is used.

For example, particles made of one or more of polyurethane, polyester, an epoxy resin, and the like or one or more of materials that reduce surface energy to improve lubricity, for example, a fluorocarbon resin, a fluorine compound, fluorocarbon, a titanium oxide, and a silicon carbide can be used such that the particles are dispersed while being reduced in diameter as needed. A material such as a fluorine rubber material that is applied with thermal treatment to form a fluorine layer on the surface and to decrease surface energy can also be used.

As needed, as a base layer, an elastic layer, or a coat layer, in order to adjust the resistance, for example, metal powder of carbon black, graphite, aluminum, or nickel or a conductive metal oxide such as tin oxide, titanium oxide, antimony oxide, indium oxide, potassium titanate, antimony oxide-tin oxide complex oxide (ATO), indium oxide-tin oxide complex oxide (ITO), or the like can be used.

In this case, the conductive metal oxide may be obtained by covering insulating fine particles of barium sulfate, magnesium silicate, calcium carbonate, or the like with a conductive metal oxide. However, the conductive metal oxide is not limited to the above materials.

A lubricant is applied to the surface of the intermediate transfer belt 8 by a lubricant application device 200 to protect the belt surface.

The lubricant application device 200 includes a solid lubricant 202 such as zinc stearate agglomerate and an application brush roller 201 serving as an application member that is brought into contact with the solid lubricant to apply lubricant powder obtained by scraping the solid lubricant with rotation to the surface of the intermediate transfer belt 8.

In this embodiment, the lubricant application device 200 is included. However, depending on toner to be applied and the material and the surface friction coefficient of an intermediate transfer belt, the lubricant application device 200 need not be always included, and lubricant need not be necessarily applied.

When image information is sent from a personal computer or the like, the printer rotationally drives the driving roller 11 to endlessly move the intermediate transfer belt 8. Extension rollers except for the driving roller 11 are rotated by following the belt. At the same time, the photoconductors 1Y, 1M, 1C, and 1K of the process units 6Y, 6M, 6C, and 6K are rotationally driven. While the surfaces of the photoconductors 1Y, 1M, 1C, and 1K are uniformly electrically charged with the charging devices 2Y, 2M, 2C, and 2K, electrostatic latent images are formed by irradiating the laser beam L on the electrically charged surfaces.

The electrostatic latent images formed on the surfaces of the photoconductors 1Y, 1M, 1C, and 1K are developed with the development devices 5Y, 5M, 5C, and 5K to obtain Y, M, C, and K toner images on the photoconductors 1Y, 1M, 1C, and 1K. The Y, M, C, and K toner images are superposed and primarily transferred on the front surface of the intermediate transfer belt 8 at the primary transfer nips for the Y, M, C and K. In this manner, a toner image in four colors is formed on the front surface of the intermediate transfer belt 8.

On the other hand, at the sheet feed section, recording sheets P are sent one by one from the sheet feed tray with a sheet feed roller 27 and transported to the pair of registration rollers. The pair of registration rollers are driven at a timing that can be synchronized with the toner image in four colors on the intermediate transfer belt 8 to send the recording sheet P to the secondary transfer nip, and the toner image in four colors on the belt is secondarily transferred on the recording sheet P in a lump. In this manner, a full-color image is formed on the surface of the recording sheet P. The recording sheet P after the full-color image is formed is transported from the secondary transfer nip to the fixing device to apply a fixing process for the toner image.

With respect to the photoconductors 1Y, 1M, 1C, and 1K after the Y, M, C, and K toner images are primarily transferred onto the intermediate transfer belt 8, a cleaning process for residual toner after transfer is performed by the drum cleaning devices 4Y, 4M, 4C, and 4K. Thereafter, after neutralization is performed with a neutralization lamp, the belt is uniformly electrically charged with the charging devices 2Y, 2M, 2C, and 2K to prepare the next image formation.

The intermediate transfer belt 8 after the image is primarily transferred onto the recording sheet P, a cleaning process of residual toner after transfer is performed by the belt cleaning device 100.

On the right of the process unit 6K for K in FIG. 2, an optical sensor unit 150 is disposed to face the front surface of the intermediate transfer belt 8 with a predetermined interval. The optical sensor unit 150, as shown in FIG. 3, has a Y optical sensor 151Y, a C optical sensor 151C, an M optical sensor 151M, and a K optical sensor 151K arrayed in the width direction of the intermediate transfer belt 8.

Each of all the sensors is formed of a reflective photosensor in which light emitted from a light-emitting element is reflected by the front surface of the intermediate transfer belt 8 and the toner image on the belt, and the reflected light quantity is detected by a light-receiving element. A controller, on the basis of output voltages from these sensors, can detect a toner image on the intermediate transfer belt 8 or detect an image density (amount of adhesion of toner per unit area) of the toner image.

In the printer, in a power-on state or each time a predetermined number of prints are completed, image density control is executed to optimize the image densities of the colors.

Figure 3:
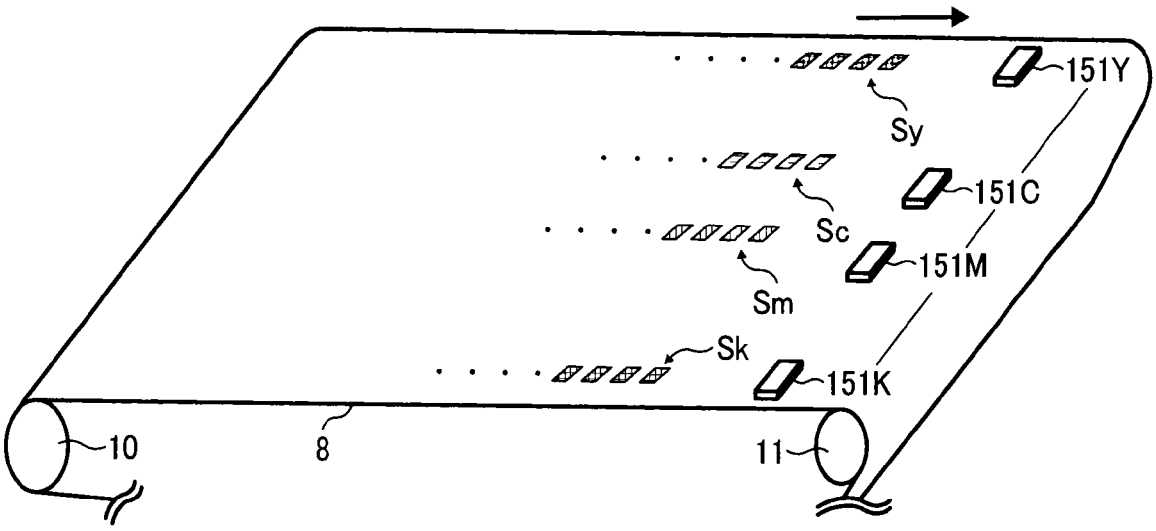
FIG. 3 is an enlarged schematic view of a gradation pattern and a configuration of an optical sensor near an intermediate transfer belt.

The image density control, as shown in FIG. 3, automatically forms gradation patterns Sk, Sm, Sc, and Sy in colors at positions facing the optical sensors 151Y, 1M, 1C, and 1K on the intermediate transfer belt 8.

The gradation patterns in colors constitute of 10 toner patches having different image densities and areas of 2 cm×2 cm. Charging potentials of the photoconductors 1Y, 1M, 1C, and 1K obtained when the gradation patterns Sk, Sm, Sc, and Sy in colors are formed are different from a uniform drum charging potential in a print process, and have values that are gradually increased. While a plurality of patch electrostatic latent images to form gradation pattern images by scanning of a laser beam are formed on the photoconductors 1Y, 1M, 1C, and 1K, respectively, the plurality of patch electrostatic latent images are developed with the development devices 5Y, 5M, 5C, and 5K for Y, M, C, and K.

In this development, the values of development biases applied to the development rollers for Y, M, C, and K are gradually increased. With the development, Y, M, C, and K gradation patterns are formed on the photoconductors 1Y, 1M, 1C, and 1K, respectively. The gradation pattern images are primarily transferred to be arrayed at predetermined intervals in a main scanning direction of the intermediate transfer belt 8. An amount of adhesion of toner of the toner patch in each of the gradation patterns is 0.1 mg/cm$^2$ at the minimum and 0.55 mg/cm$^2$ at the maximum. When toner charge-per-diameter (Q/d) distributions are measured, the polarities of the toners are almost equalized to the regular charging polarity.

The toner patterns (Sk, Sm, Sc, and Sy) formed on the intermediate transfer belt 8 pass through positions facing the optical sensors 151 with the endless movement of the intermediate transfer belt 8. At this time, the optical sensors 151 receive amounts of light depending on amounts of adhesion of toner per unit area to the toner patches of the gradation patterns, respectively.

On the basis of output voltages from the optical sensors 151 when the toner patches are detected and an adhesion amount conversion algorithm, amounts of adhesion on the toner patches of the toner patterns in colors are calculated. On the basis of the calculated amounts of adhesion, image forming conditions are adjusted.

More specifically, on the basis of the results of detection of the amounts of adhesion of toner on the toner patches and development potentials obtained when the toner patches are formed, a function (y=ax+b) representing the linear graph is calculated by regression analysis. Target values of the image densities are assigned to the function to calculate appropriate development biases, so that development biases for Y, M, C, and K are specified.

In the memory, an image formation condition data table is stored in which several tens of kinds of development biases and appropriate drum charging potentials respectively corresponding to the biases are associated with each other. With respect to the process units 6Y, 6M, 6C, and 6K, development biases that are closest to the specified development biases are selected from the image formation condition table to specify drum charging potentials associated with the selected development biases.

The printer is configured to also perform color shift correction processing when the printer is powered on or when a predetermined number of prints are completed. In the color shift correction processing, color shift detection images called chevron patches PV as shown in FIG. 4 and constituted of Y, M, C, and K toner images are formed at each of one end and the other end of the intermediate transfer belt 8 in the width direction, respectively.

Figure 4:
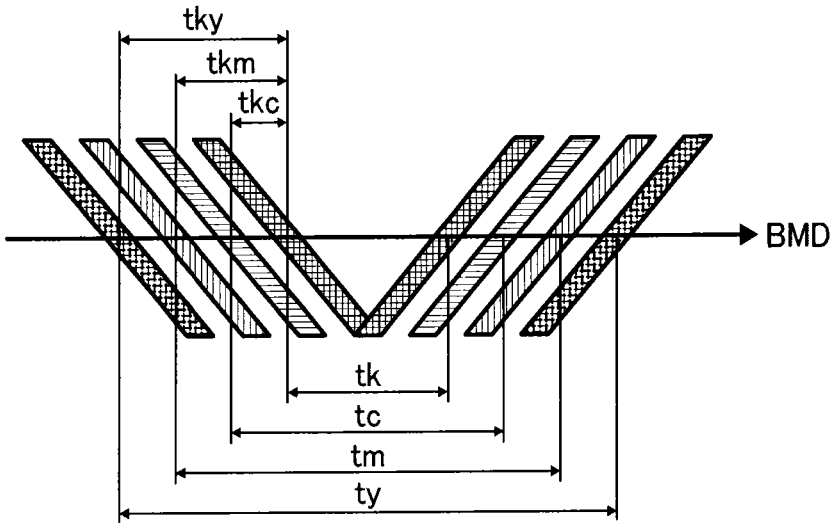
FIG. 4 is an enlarged schematic view of a chevron patch formed on the intermediate transfer belt.

The chevron patch PV, as shown in FIG. 4, is a line pattern group in which the Y, M, C, and K toner images are arrayed at predetermined pitches in a belt moving direction (indicated by arrow BMD) that is a sub-scanning direction while the toner images are tilted at about 45° relative to the main scanning direction. An amount of adhesion of the chevron patch PV is about 0.3 mg/cm$^2$.

The color toner images in the chevron patches PV formed at both the ends of the intermediate transfer belt 8 in the width direction are detected. In this manner, positions in the main scanning direction (axial direction of the photoconductor) in the color toner images, positions in the sub-scanning direction (belt moving direction BMD), magnification errors in the main scanning direction, and skew from the main scanning direction are detected. The main scanning direction mentioned here indicates a direction in which a laser beam is phase-shifted on the surface of the photoconductor with reflection on a polygon mirror.

Detection time differences between the Y, M, and C toner images in the chevron patch PV and the K toner image are read by the optical sensors 151. In FIG. 4, the vertical direction corresponds to the main scanning direction, and the Y, M, C, and K toner images are sequentially arrayed from the left. Thereafter, K, C, M, and Y toner images having postures different from those of the above Y, M, C, and K toner images by 90° are further arrayed.

On the basis of differences between measured values and ideal values of detection time differences tky, tkm, and tkc obtained with reference to the K color serving as a reference color, deviations of the color toner images in the sub-scanning direction, i.e., registration deviations, are calculated. On the amount of registration deviations, every other surface of the polygon mirror in the optical writing unit 20, i.e., using one scanning line pitch as one unit, an optical writing start timing for a photoconductor 1 is corrected to reduce the registration deviations of the color toner images.

On the basis of the differences of sub-scanning direction deviations between both the ends of the belt, tilts (skews) of the color toner images from the main scanning direction are calculated. On the basis of the result, plate tilt correction of an optical reflecting mirror is performed to reduce skew deviations of the color toner images.

Processing that corrects an optical writing start timing and a plate tilt on the basis of timings at which the toner images in the chevron patch PV are detected to reduce registration deviations and skew deviations is color shift correction processing. The color shift correction processing can suppress color shift of an image caused by shifting forming positions of the color toner images on the intermediate transfer belt 8 with time due to a change in temperature or the like.

When the image forming operation in a small image area continues, old toner continuously remaining in the development device for a long time increases. For this reason, the toner charging characteristics are deteriorated, and use of the toner in image formation deteriorates image quality (deterioration in development capability and transfer properties). The image forming device includes a refresh mode in which old toner is ejected into a non-image region of the photoconductor 1 at a predetermined timing not to be accumulated in the development device, and, after the toner is ejected, a new toner is supplied to the development device having a decreased toner concentration to refresh the interior of the development device.

A controller stores consumptions of toner of the development devices 5Y, 5M, 5C, and 5K and operation times of the development devices 5Y, 5M, 5C, and 5K therein in advance. At a predetermined timing, the controller examines whether a consumption of toner for an operation time in a predetermined period of each development device is a threshold value or less in each of the developments, and executes the refresh mode to a development device having a consumption of toner that is the threshold value or less.

Figure 5:
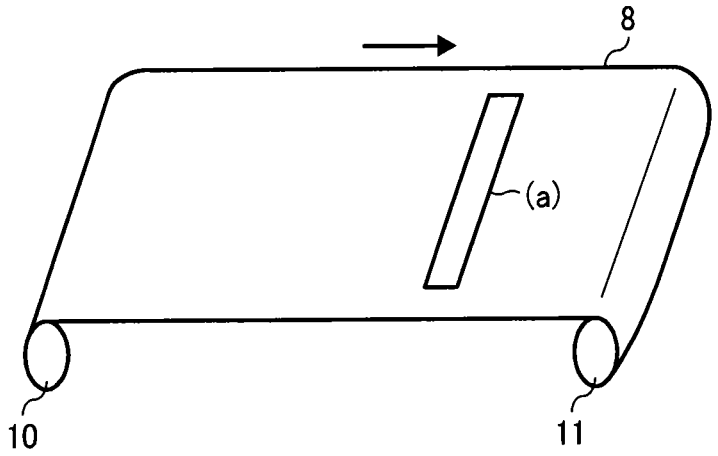
FIG. 5 is a schematic view of a toner consumption pattern.

When the refresh mode is executed, a toner consumption pattern is formed in a non-image-forming region corresponding to a region between sheets of the photoconductor 1 and transferred to the intermediate transfer belt 8 (FIG. 5). An amount of adhesion to the toner consumption pattern is determined on the basis of a consumption of toner for an operation time in a predetermined period of the development device, and a maximum amount of adhesion per unit area on the intermediate transfer belt 8 may be about 1.2 mg/cm$^2$. When a toner Q/d distribution of a toner consumption pattern (a) transferred to the intermediate transfer belt 8 is measured, the charging property is almost equalized to the regular charging polarity. In this embodiment, the size of the toner consumption pattern is set to 25 mm×250 mm.

The color gradation patterns, the chevron patches, and the toner consumption pattern formed on the intermediate transfer belt 8 are collected by the belt cleaning device 100. At this time, the belt cleaning device 100 must remove a large amount of toner from the intermediate transfer belt 8.

However, in a cleaning device including a conventional polarity controller and a brush roller and a cleaning device including a brush roller for removing toner having a positive polarity and a brush roller for removing toner having a negative polarity, the following problems are posed. More specifically, the non-transferred toner images such as the color gradation patterns, the chevron patches, and the toner consumption pattern cannot be removed in a lump. In such a case, the toner on the intermediate transfer belt 8 that cannot be completely cleaned is transferred onto a recording sheet in the next print operation, and an abnormal image may be formed.

Thus, the belt cleaning device 100 of the printer is configured such that non-transferred toner images such as the color gradation patterns, the chevron patches, and the toner consumption pattern can be removed in a lump. The configuration will be concretely described below.

Figure 6:
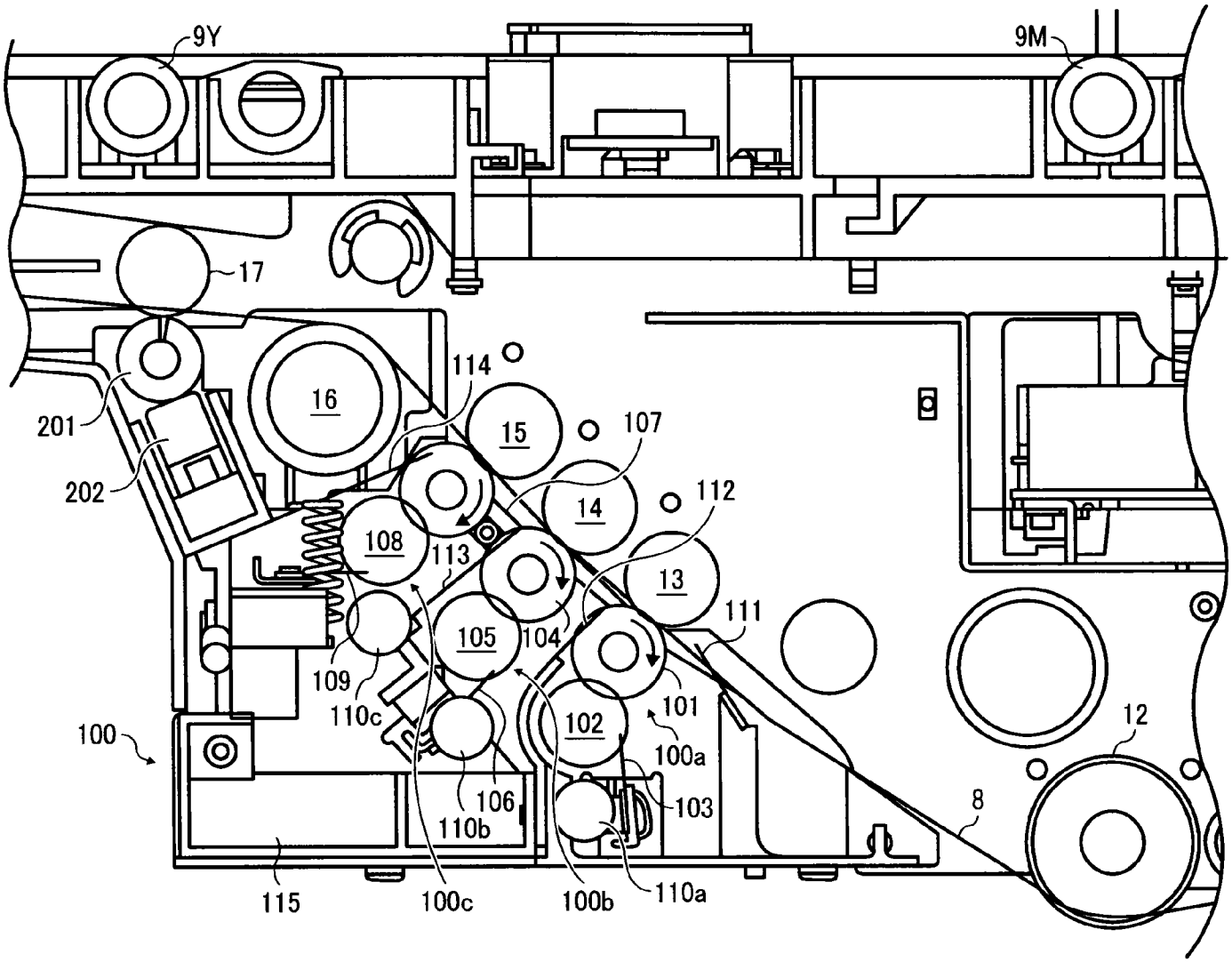
FIG. 6 is an enlarged view of a configuration of a belt cleaning device and a periphery thereof.

FIG. 6 is an enlarged view of a configuration of the belt cleaning device 100 including three belt cleaners and its circumference.

In FIG. 6, the belt cleaning device 100 includes a pre-cleaning unit 100*a*, a reversely-charged-toner cleaning unit 100*b*, and a regularly-charged toner cleaning unit 100*c*.

The pre-cleaning unit 100*a* removes the non-transferred toner images on the intermediate transfer belt 8. The reversely-charged-toner cleaning unit 100*b* removes toner charged to have a positive polarity opposite the negative polarity that is the regular charging polarity on the intermediate transfer belt 8. The regularly-charged toner cleaning unit 100*c* removes toner charged to have a negative polarity that is the regular charging polarity on the intermediate transfer belt 8.

The pre-cleaning unit 100*a*, the reversely-charged-toner cleaning unit 100*b*, and the regularly-charged toner cleaning unit 100*c* have transport screws 110*a*, 110*b*, and 110*c*, respectively, to transport the toner removed from the intermediate transfer belt 8 to the outside of the printer.

The pre-cleaning unit 100*a* has a pre-cleaning brush roller 101 serving as a pre-cleaner. The cleaning device 100 has a pre-collection roller 102 serving as a pre-collection member that collects toner adhering to the pre-cleaning brush roller 101 and a pre-scraping blade 103 serving as a pre-scraping member that is brought into contact with the pre-collection roller 102 to scrape the toner from the roller surface.

Most of toner constituting the non-transferred toner images is charged to have a negative polarity that is the regular charging polarity. For this reason, a positive voltage having a polarity opposite the regular charging polarity is applied to the pre-cleaning brush roller 101 to electrostatically remove negative toner on the intermediate transfer belt 8. A positive voltage higher than that applied to the pre-cleaning brush roller 101 is applied to the pre-collection roller 102.

In the belt cleaning device 100, a voltage applied to the pre-cleaning brush roller 101 and the like are set such that 90% of the non-transferred toner images are removed by the pre-cleaning brush roller 101.

The reversely-charged-toner cleaning unit 100*b* is disposed on the downstream side of the pre-cleaning unit 100*a* in the moving direction of the intermediate transfer belt 8. The belt cleaning device 100 has a reversely-charged toner cleaning brush roller 104 serving as a reversely-charged toner cleaner that electrostatically removes toner positively charged to have a polarity opposite the negative polarity that is the regular charging polarity of toner.

The belt cleaning device 100 also includes reversely-charged toner collection roller 105 serving as a reversely-charged toner collection member that collects reversely-charged toner adhering to the reversely-charged toner cleaning brush roller 104. Furthermore, the belt cleaning device 100 includes a reversely-charged toner scraping blade 106 serving as a reversely-charged toner scraping member that is brought into contact with the reversely-charged toner collection roller 105 to scrape reversely-charged toner from the roller surface.

A voltage having a negative polarity equal to the regular charging polarity of toner is applied to the reversely-charged toner cleaning brush roller 104, and a negative voltage having an absolute value larger than that of the voltage applied to the reversely-charged toner cleaning brush roller 104 is applied to the reversely-charged toner collection roller 105.

The reversely-charged-toner cleaning unit 100*b* also has a function to negatively charge toner on the intermediate transfer belt 8 to equalize the charging polarity of the toner on the intermediate transfer belt 8 to the negative polarity.

The regularly-charged toner cleaning unit 100*c* is disposed on the downstream side of the reversely-charged-toner cleaning unit 100*b* in the moving direction of the intermediate transfer belt 8. The belt cleaning device 100 has a regularly-charged toner cleaning brush roller 107 serving as a regularly-charged toner cleaner that electrostatically removes toner charged to have the regular charging polarity.

The belt cleaning device 100 includes a regularly-charged toner collection roller 108 serving as a regularly-charged toner collection member that collects regularly-charged toner adhering to the regularly-charged toner cleaning brush roller 107. Furthermore, the belt cleaning device 100 includes a regularly-charged toner scraping blade 109 serving as a regularly-charged toner scraping member that is brought into contact with the regularly-charged toner collection roller 108 to scrape regularly-charged toner from the roller surface.

A positive voltage having a polarity opposite the regular charging polarity of toner is applied to the regularly-charged toner cleaning brush roller 107. A positive voltage having an absolute value higher than that of the voltage applied to the regularly-charged toner cleaning brush roller 107 is applied to the regularly-charged toner collection roller 108.

The pre-cleaning unit 100*a* and the reversely-charged-toner cleaning unit 100*b* are partitioned from each other with a first insulating seal member 112. The pre-cleaning unit 100*a* and the reversely-charged-toner cleaning unit 100*b* are partitioned from each other with the first insulating seal member 112 to make it possible to suppress electric discharge from occurring between the pre-cleaning brush roller 101 and the reversely-charged toner cleaning brush roller 104. Furthermore, the toner removed by the reversely-charged-toner cleaning unit 100*b* can be suppressed from re-adhering to the pre-cleaning brush.

The reversely-charged-toner cleaning unit 100*b* and the regularly-charged toner cleaning unit 100*c* are partitioned from each other with a second insulating seal member 113. The reversely-charged-toner cleaning unit 100*b* and the regularly-charged toner cleaning unit 100*c* are partitioned from each other with the second insulating seal member 113 to make it possible to suppress electric discharge from occurring between the reversely-charged toner cleaning brush roller 104 and the regularly-charged toner cleaning brush roller 107. Furthermore, the toner removed by the regularly-charged toner cleaning unit 100*c* can be suppressed from re-adhering to the reversely-charged toner cleaning brush roller 104.

At an outlet port of the belt cleaning device 100, a third insulating seal member 114 is disposed. In this manner, electric discharge can be suppressed from occurring between the regularly-charged toner cleaning brush roller 107 and the tension roller 16. The belt cleaning device 100 includes an inlet port seal 111.

Each of the cleaning brush rollers 101, 104, and 107 includes a metal rotation shaft that is rotationally supported and a brush unit having a plurality of raising fibers standing on the peripheral surface of the rotation shaft and has an external diameter of ϕ15 to 16 mm.

Each of the raising fibers has a two-layered core-sheath structure in which the inside of each of the raising fibers is made of a conductive material such as conductive carbon, and the surface portion of each of the rising fibers is made of an insulating material such as polyester.

In this manner, the cores have the same potential as that of the voltages applied to the cleaning brush rollers 101, 104, and 107, and toner can be electrostatically attracted to the surfaces of the rising fibers. As a result, toner on the intermediate transfer belt 8 electrostatically adheres to the raising fibers by the actions of the voltages applied to the cleaning brush rollers 101, 104, and 107.

The raising fibers of the cleaning brush rollers 101, 104, and 107 may be formed of only conductive fibers. So-called pile slanting may be performed such that fibers are planted to be slanted with respect to a normal direction of the rotation shaft.

The raising fibers on the pre-cleaning brush roller 101 and the regularly-charged toner cleaning brush roller 107 may have core-sheath structures, and the raising fibers of the reversely-charged toner cleaning brush roller 104 may be configured by only conductive fibers.

When the raising fibers of the reversely-charged toner cleaning brush roller 104 are configured by only the conductive fibers, charge injection from the reversely-charged toner cleaning brush roller 104 into toner is likely to occur. In this manner, the reversely-charged toner cleaning brush roller 104 can preferably equalize the toner on the intermediate transfer belt 8 to the negative polarity.

On the other hand, when the raising fibers on the pre-cleaning brush roller 101 and the regularly-charged toner cleaning brush roller 107 have core-sheath structures, charge injection into the toner can be suppressed, and the toner on the intermediate transfer belt 8 can be suppressed from being positively charged. In this manner, on the pre-cleaning brush roller 101 and the regularly-charged toner cleaning brush roller 107, toner that cannot be electrostatically removed can be suppressed from being generated.

The cleaning brush rollers 101, 104, and 107 are caused to cut into the intermediate transfer belt 8 by 1 mm, and are rotated by a driving unit such that the raising fibers move in a direction (counter direction) opposing the moving direction of the intermediate transfer belt at a contact position.

In the contact position, the cleaning brush rollers 101, 104, and 107 are rotated to move the rising fibers in the counter direction so that a linear velocity difference between the cleaning brush rollers 101, 104, and 107 and the intermediate transfer belt 8 can be increased. In this manner, a probability of contact to the raising fibers increases in a period until a certain position of the intermediate transfer belt 8 passes through contact areas to the cleaning brush rollers 101, 104, and 107, and the toner can be preferably removed from the intermediate transfer belt 8.

In the belt cleaning device 100, stainless steel (SUS) rollers are used as the collection rollers 102, 105, and 108.

The collection rollers 102, 105, and 108 may be made of any material as long as a function of dislocating the toner adhering to the cleaning brush rollers 101, 104, and 107 with potential gradients of the raising fibers and the collection rollers 102, 105, and 108.

For example, as each of the collection rollers 102, 105, and 108, a roller obtained by covering a conductive metal core with a high-resistance elastic tube having a size of several μm to 100 μm or coating the conductive metal core with an insulator to make a roller resistance log R=12Ω to 13Ω may be used.

Cost cutting or suppression of an application voltage to a low level can be achieved by using the stainless steel (SUS) rollers as the collection rollers 102, 105, and 108, and electric power saving can be advantageously achieved.

On the other hand, the roller resistance is given by log R=12Ω to 13Ω to make it possible to suppress electric charge injection into toner in collection of the toner in the collection rollers 102, 105, and 108. In this manner, the toner has the same polarity as that of the application voltages of the collection rollers 102, 105, and 108 to make it possible to suppress a rate of collection of toner from decreasing.

In this manner, in the belt cleaning device 100, the pre-cleaning brush roller 101 is disposed to roughly remove negative toner occupying most part of the non-transferred toner images by the pre-cleaning brush roller 101. For this reason, an amount of toner input to the reversely-charged toner cleaning brush roller 104 or the regularly-charged toner cleaning brush roller 107 can be reduced.

Toner on the intermediate transfer belt 8 moved to the regularly-charged toner cleaning brush roller 107 on the most downstream side in the belt moving direction is the toner that is not removed by the pre-cleaning roller 101 and the reversely-charged toner cleaning brush roller 104. For this reason, the toner amount is very small. The toner is equalized to the negative polarity by the reversely-charged toner cleaning brush roller 104.

Thus, the remaining toner can be preferably removed by the regularly-charged toner cleaning brush roller 107. In this manner, even an non-transferred toner image obtained by causing a large amount of toner to adhere to the intermediate transfer belt 8 can be preferably removed from the intermediate transfer belt 8.

A discharged-matter transport unit 51 that serves as a characteristic unit of the printer according to this embodiment and transports discharged matter such as toner discharged from the belt cleaning device 100 or the like will be described below.

Figure 7:
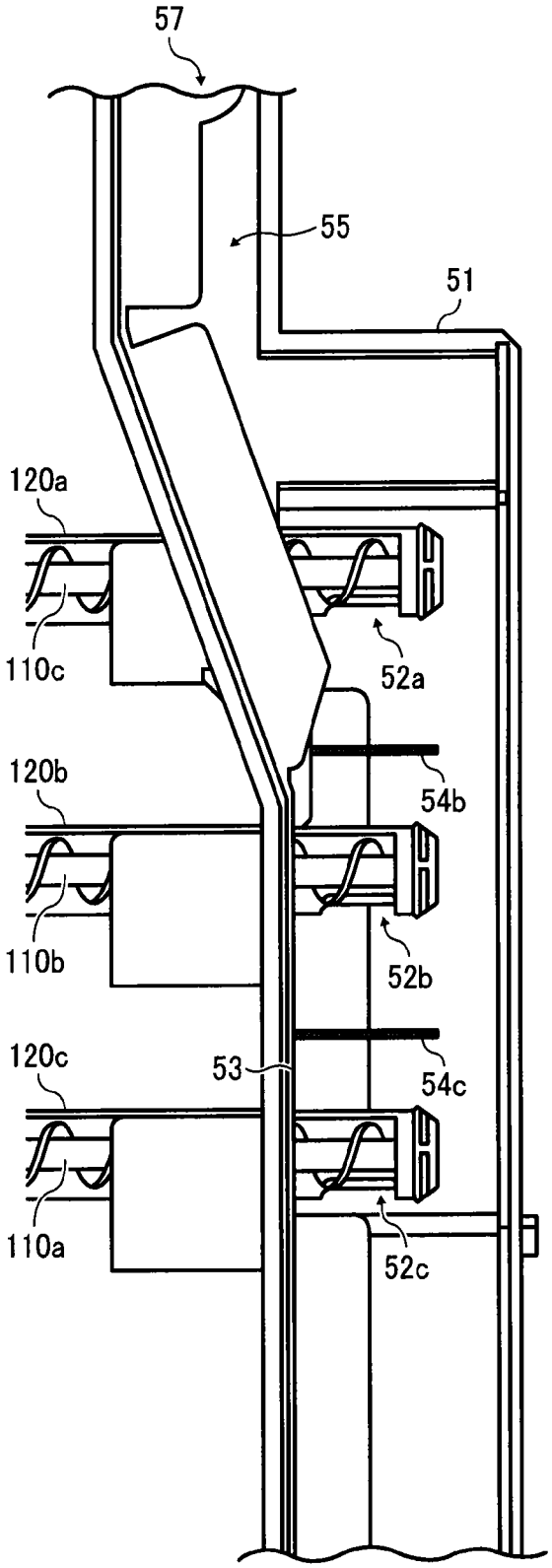
FIG. 7 is a side view of the discharged-matter transport unit shown in FIG. 1.
Figure 8:
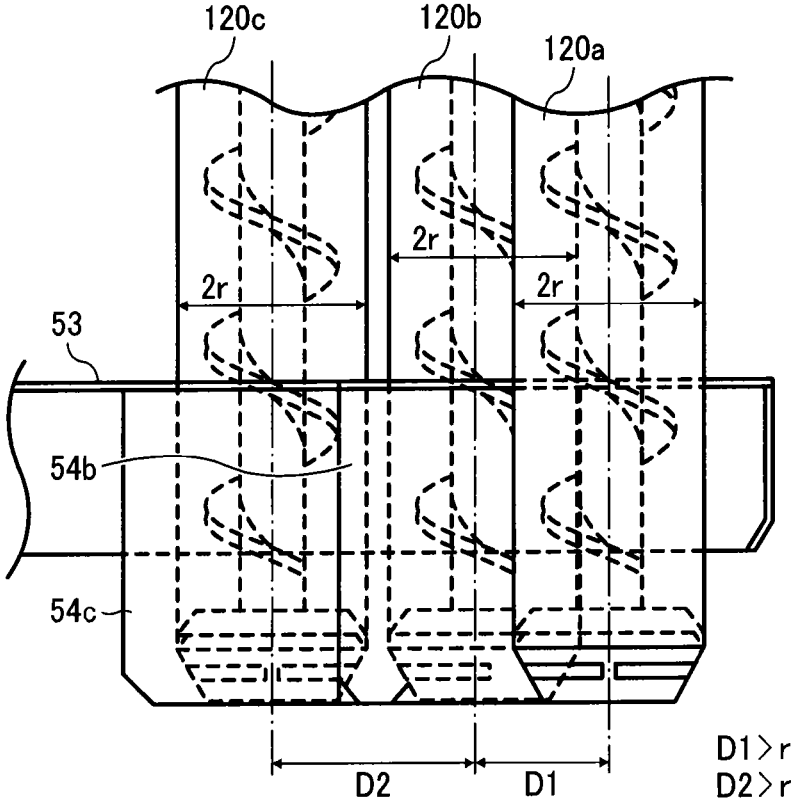
FIG. 8 is a diagram showing a positional relationship between three discharging units of the discharged-matter transport unit when viewed from the upper side in a vertical direction.
Figure 9:
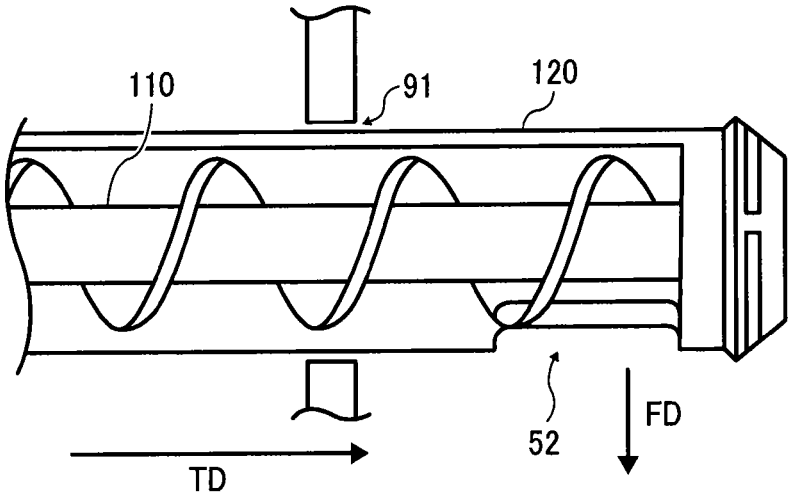
FIG. 9 is a schematic view of a cylindrical transport path forming member having an ejection port formed on one end side.

FIG. 1 is a front view of the discharged-matter transport unit 51. FIG. 7 is a side view of the discharged-matter transport unit 51. FIG. 8 is a schematic view of the positional relationship between three toner transport pipes 120*a*, 120*b*, and 120*c* in the discharged-matter transport unit 51 from the upper side in the vertical direction. FIG. 9 is a schematic view of a toner transport pipe 120 serving as a cylindrical transport path forming member having an ejection port 52 formed on one end side.

The printer according to this embodiment includes the three toner transport pipes 120*a*, 120*b*, and 120*c* serving as cylindrical transport path forming members. The three toner transport pipes 120*a*, 120*b*, and 120*c* form transport paths to transport toner removed from the surface of the intermediate transfer belt 8 by the belt cleaning device 100, in a discharged-matter transport direction indicated by arrow TD in FIG. 9. One ends of the toner transport pipes 120*a*, 120*b*, and 120*c* are connected to the belt cleaning device 100. The other ends of the toner transport pipes 120*a*, 120*b*, and 120*c* are disposed to be inserted into through holes 91*a*, 91*b*, and 91*c* formed in the side wall of the discharged-matter transport unit 51. The discharged-matter transport unit 51 includes a discharged-matter falling path 55 serving as a falling transport path for causing toner to gravitationally fall in a discharged-matter falling direction indicated by arrow FD in FIG. 9. Toner ejected from ejection ports 52*a*, 52*b*, and 52*c* formed in the other ends of the toner transport pipes 120*a*, 120*b*, and 120*c* is caused to gravitationally fall and transported into the discharged-matter falling path 55.

In the discharged-matter transport unit 51, above the toner transport pipes 120*a*, 120*b*, and 120*c*, a discharged-matter falling port 57 serving as an opening to send discharged matter such as toner to the discharged-matter falling path 55 is formed. Discharged matter such as toner discharged from the discharged-matter falling port 57 is caused to gravitationally fall by the discharged-matter falling path 55 and transported.

The ejection port 52, as shown in FIG. 9, is formed in a lower portion on the other end side of the toner transport pipe 120 located in the discharged-matter transport unit 51. The toner removed from the intermediate transfer belt 8 by the belt cleaning device 100 is transported toward the ejection port 52 by a transport screw 110 rotationally disposed in the toner transport pipe 120, and sent into the discharged-matter transport unit 51 through the ejection port 52.

Figure 10:
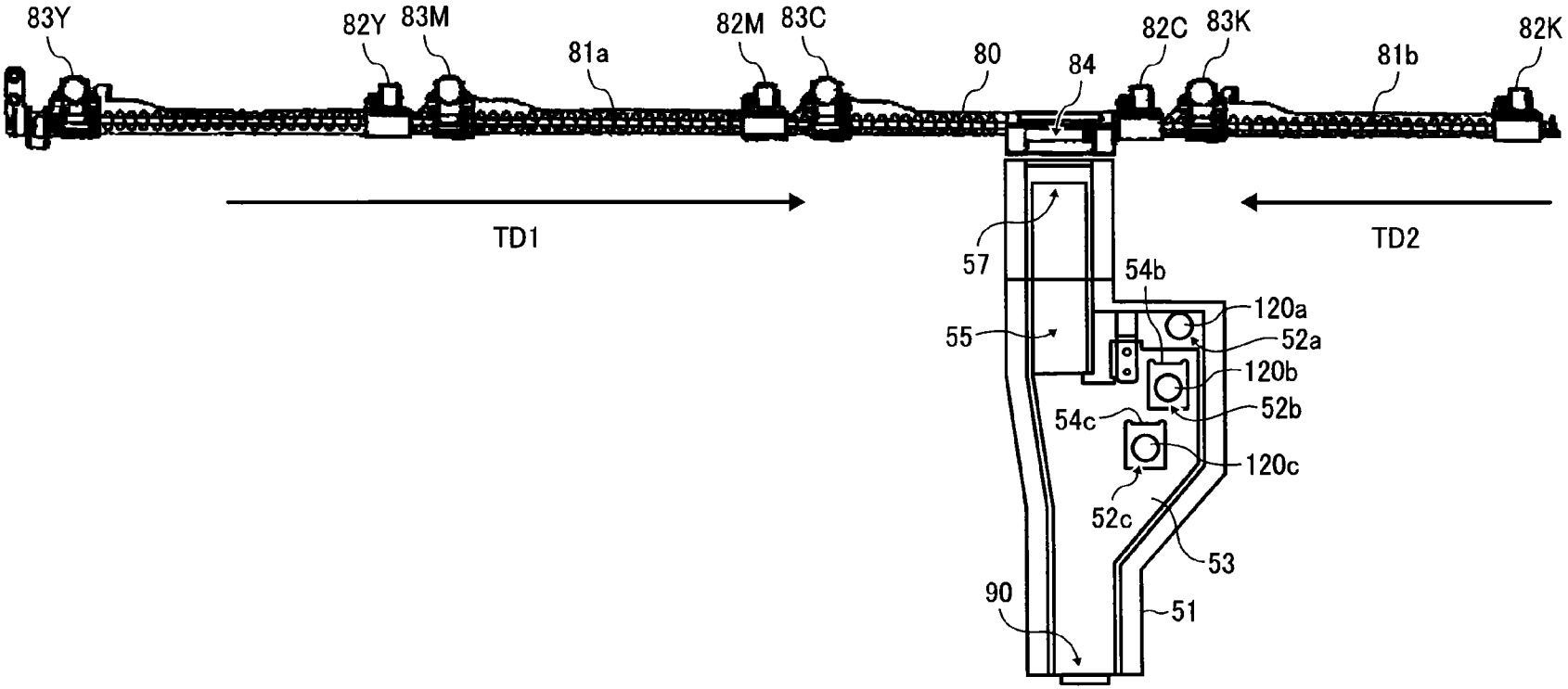
FIG. 10 is a schematic view of a horizontal transport path formed above the discharged-matter transport unit.

Waste toner discharged from a drum cleaning device 4, a developer discharged from a development device 5, and the like are discharged into the discharged-matter falling port 57 through drum cleaning discharge ports 82Y, 82M, 82C, and 82K and development discharge ports 83Y, 83M, 83C, and 83K in a horizontal transport path 80 shown in FIG. 10. Discharged matters such as the waste toner and the developer are transported in discharged-matter transport directions TD1 and TD2 with rotation of transport screws 81*a* and 81*b*, respectively, disposed in the horizontal transport path 80, pass through a discharge port 84 and the discharged-matter falling port 57 by free fall, and is sent into the discharged-matter transport unit 51.

In a high-temperature and high-humidity environment, toner passing through the discharged-matter falling path 55 by free fall adheres to the internal surface of the discharged-matter falling path 55 on the way of falling, is agglomerated and gradually deposited, and gradually narrows down the discharged-matter falling path 55 to form a toner bridge, so that the toner bridge blocks toner collection.

For this reason, in the discharged-matter transport unit 51 according to this embodiment, in order to suppress such a toner bridge from being formed, in the discharged-matter transport unit 51, a swing plate 53 is disposed to reciprocally move in vertical directions.

Figure 11:
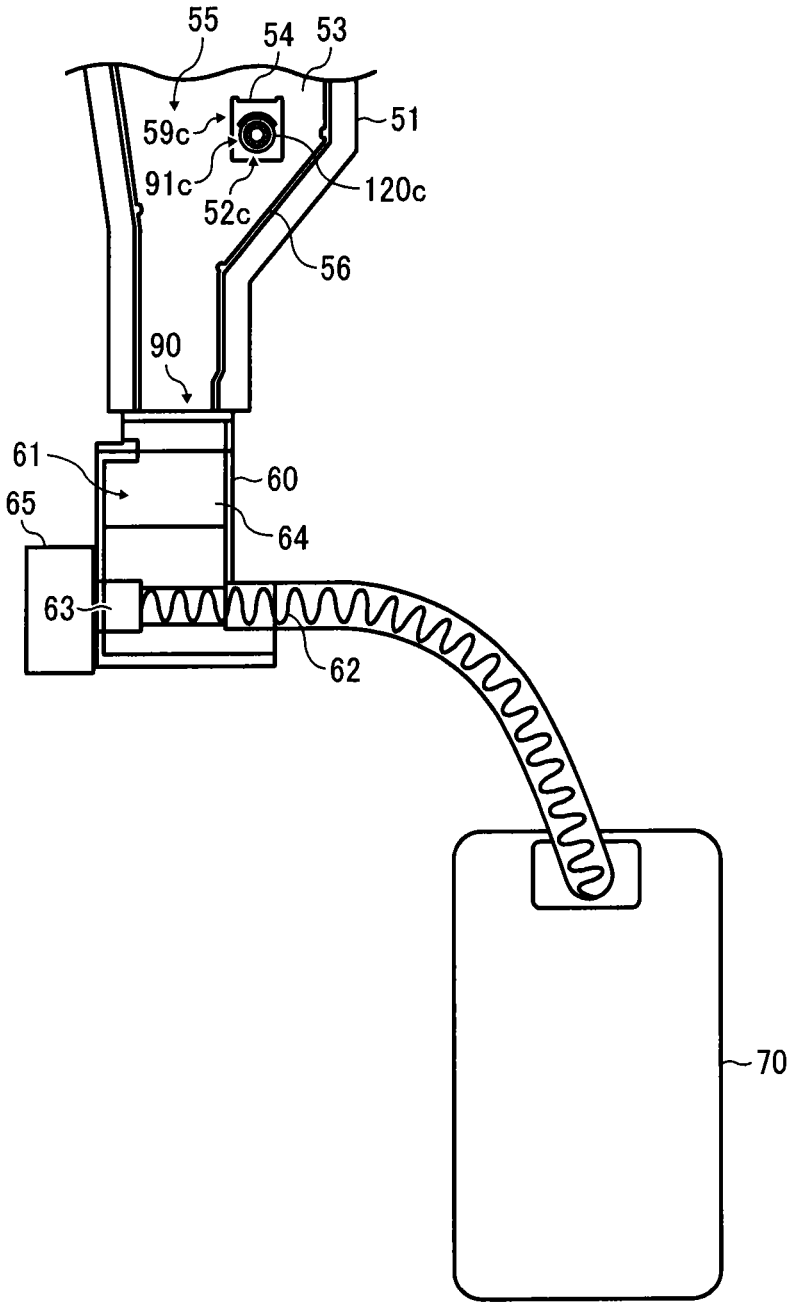
FIG. 11 is a front view of a downstream unit disposed on the downstream side of the discharged-matter transport unit.
Figure 12:
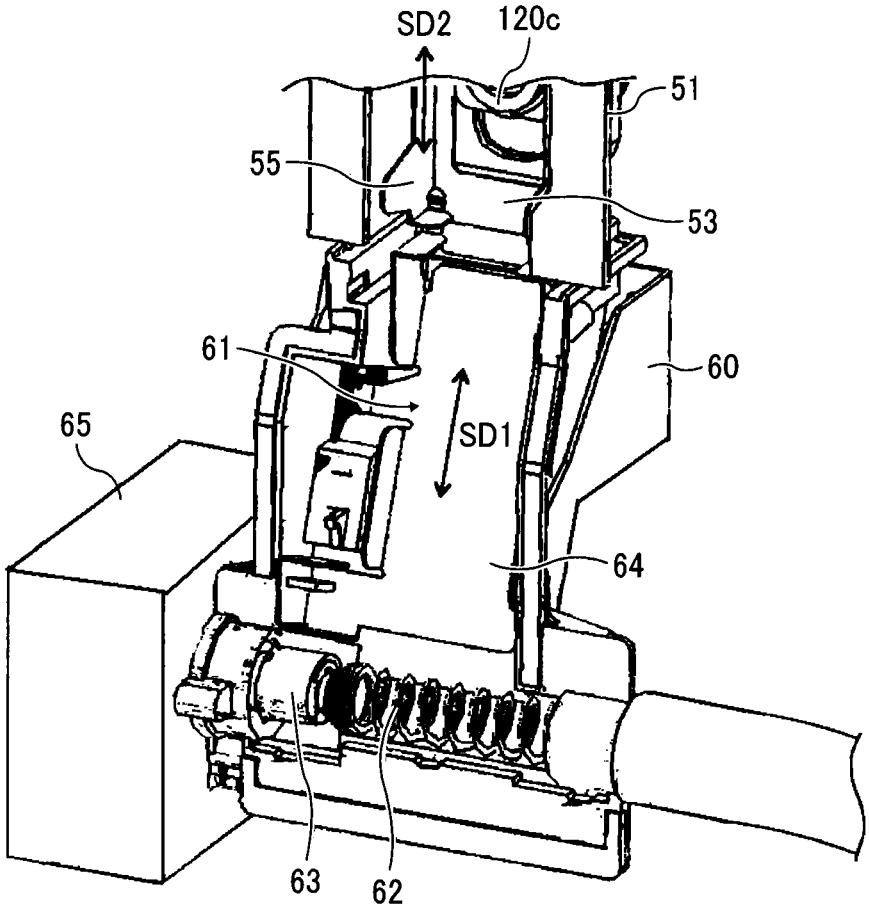
FIG. 12 is a perspective view of a downstream unit shown in FIG. 11.

FIG. 11 is a front view of a downstream unit 60 disposed on the downstream side of the discharged-matter transport unit 51. FIG. 12 is a perspective view of the downstream unit 60.

As shown in FIG. 11 and FIG. 12, under the discharged-matter transport unit 51, the downstream unit 60 having a vertical transport path 61 is disposed extending in the vertical direction of the apparatus, and a discharge port 90 formed in a lower portion of the discharged-matter falling path 55 in the discharged-matter transport unit 51 communicates with the vertical transport path 61. Discharged matter such as toner caused to fall in the discharged-matter falling path 55 of the discharged-matter transport unit 51 and transported is sent into the vertical transport path 61 of the downstream unit 60 through the discharge port 90.

A transport coil 62 to transport the discharged matter such as the toner in the downstream unit 60 to a discharged-matter storing unit 70 in the further downstream side is rotationally disposed on the lowermost portion of the vertical transport path 61 in the downstream unit 60. When the transport coil 62 is rotated by a rotating drive force from a driving device 65, a cam 63 disposed on the end of the transport coil 62 on the drive device side rotates together with the transport coil 62, and the rotational movement vertically moves the swing plate 64.

When the swing plate 64 is vertically moved to swing as indicated by arrow SD1, toner adhering to the swing plate 64 is fell and removed, thus suppressing formation of a toner bridge in the vertical transport path 61.

When the swing plate 64 moves upward by the vertical movement of the swing plate 64, the swing plate 53 in the discharged-matter transport unit 51 is pressed upward, and the swing plate 53 also vertically moves. More specifically, the swing plate 53 is swung such that rotational movement of the cam 63 on the vertical transport path 61 under the discharged-matter transport unit 51 shown in FIG. 1 is converted in vertical reciprocal movement (indicated by arrow SD2 in FIG. 12) through the swing plate 64.

In FIG. 1, the other ends of the toner transport pipes 120*a*, 120*b*, and 120*c* are disposed on the side wall of the discharged-matter transport unit 51 while being displaced in the horizontal direction. The other ends of the toner transport pipes 120*a*, 120*b*, and 120*c* are disposed on the side wall of the discharged-matter transport unit 51 while being displaced in the vertical direction. The other ends of the toner transport pipes 120*a*, 120*b*, and 120*c* are disposed on the side wall of the discharged-matter transport unit 51 while being arrayed in an oblique direction with respect to the vertical direction.

Assume that the other ends of the toner transport pipes 120*a*, 120*b*, and 120*c* are disposed on the side wall of the discharged-matter transport unit 51 while being linearly arrayed in the vertical direction. In this case, toner ejected from the ejection port 52*a* of the toner transport pipe 120*a* located on the upper side of the toner transport pipe 120*b* in the vertical direction is accumulated on the outer circumferential surface of the toner transport pipe 120*b*. Similarly, toner ejected from the ejection ports 52*a* and 52*b* of the toner transport pipes 120*a* and 120*b* located on the upper side of the toner transport pipe 120*c* in the vertical direction is accumulated on the outer circumferential surface of the toner transport pipe 120*c*.

In an exchange operation of the belt cleaning device 100 due to its life time or breakdown, when the belt cleaning device 100 is to be removed from the printer body, toner accumulated on the outer circumferential surfaces of the toner transport pipes 120*b* and 120*c* may spill out to stain the interior of the image forming apparatus. In particular, when toner spills out in the transfer unit in which the secondary transfer roller 18 of the transfer unit 7 is disposed, the toner may adversely affect image quality.

Furthermore, the toner accumulated on the outer circumferential surfaces of the toner transport pipes 120*b* and 120*c* is agglomerated, gradually grows, and gradually narrows down the discharged-matter falling path 55 to form a toner bridge so as to hamper toner transport.

In FIG. 8, a horizontal distance between the centers of the toner transport pipe 120*a* (ejection ports 52*a*) and the toner transport pipe 120*b* (ejection port 52*b*) that are adjacent to each other is given by D1. A horizontal distance between the centers of the toner transport pipe 120*b* (ejection ports 52*b*) and the toner transport pipe 120*c* (ejection port 52*c*) that are adjacent to each other is given by D2. A radius of each of the cylindrical toner transport pipes 120*a*, 120*b*, and 120*c* is given by r. At this time, in the configuration shown in FIG. 1, D1>r and D2>r are satisfied. More specifically, each of the shift amounts of the horizontal positions of the toner transport pipes 120*a*, 120*b*, and 120*c* when viewed in the vertical direction is half or more the horizontal width of each of the toner transport pipes 120.

In this manner, when the other ends of the toner transport pipes 120*a*, 120*b*, and 120*c* are disposed on the side wall while being displaced in the horizontal direction, the toner from the ejection ports 52*a* and 52*b* is not easily accumulated on the outer circumferential surfaces of the toner transport pipes 120*b* and 120*c*. More specifically, in comparison with the case in which the toner transport pipes 120*a*, 120*b*, and 120*c* are straightly arrayed in the vertical direction, deposition of the toner from the ejection ports 52*a* and 52*b* onto the outer circumferential surface can be reduced.

In FIG. 1, guards 54*b* and 54*c* serving as first covers covering the outer circumferential surfaces of the toner transport pipes 120*b* and 120*c* are disposed above the toner transport pipes 120*b* and 120*c* in the vertical direction in the discharged-matter transport unit 51.

In this manner, in the toner transport pipes 120*b* and 120*c*, the toner ejected from the ejection ports 52*a* and 52*b* of the toner transport pipes 120*a* and 120*b* located above the toner transport pipes 120*b* and 120*c* is accumulated on the guards 54*b* and 54*c*. For this reason, the guards 54*b* and 54*c* suppress toner from spilling out on the outer circumferential surfaces of the toner transport pipes 120*b* and 120*c*, and an effect of preventing toner from being deposited on the outer circumferential surfaces of the toner transport pipes 120*b* and 120*c* can be improved.

The guards 54 are configured as a part of the swing plate 53. In this manner, the guards 54 are also swung by swinging the swing plate 53, and the toner deposited on the guards 54 can be removed by vibration, so that the toner can be suppressed from being deposited on the guards 54.

In the swing plate 53, through holes 59*b* and 59*c* through which the toner transport pipes 120*a*, 120*b*, and 120*c* penetrate are formed not to be in contact with the toner transport pipes 120*b* and 120*c*. The through holes 59*b* and 59*c* are formed to form the guards 54*b* and 54*c*.

More specifically, peripheries of through hole forming portions on the swing plate 53 in which the through holes 59*b* and 59*c* are formed to correspond to the other ends of the toner transport pipes 120*b* and 120*c* are cut out such that the upper sides of the wall surfaces of the through hole forming portions are continuously connected to wall surfaces near the through hole forming portions. Parts of the through hole forming portions of the swing plate 53 are bent to form the through holes 59*b* and 59*c*. The bent parts of the through hole forming portions of the swing plate 53 are used as the guards 54*b* and 54*c*.

In this manner, the guards 54 need not be disposed on the swing plate 53 as independent components to reduce the cost.

Since the guards 54*b* and 54*c* formed on the swing plate 53 are swung with the swinging of the swing plate 53, in order to prevent the guards 54*b* and 54*c* from being in contact with the toner transport pipes 120*b* and 120*c*, gaps are desirably formed between the guards 54*b* and 54*c* and the ejection ports 52*b* and 54*c*. However, when the gaps are formed, flying toner enters into the small gaps, and the toner may be deposited on the outer circumferential surfaces of the toner transport pipes 120*b* and 120*c* bit by bit.

Figure 13:
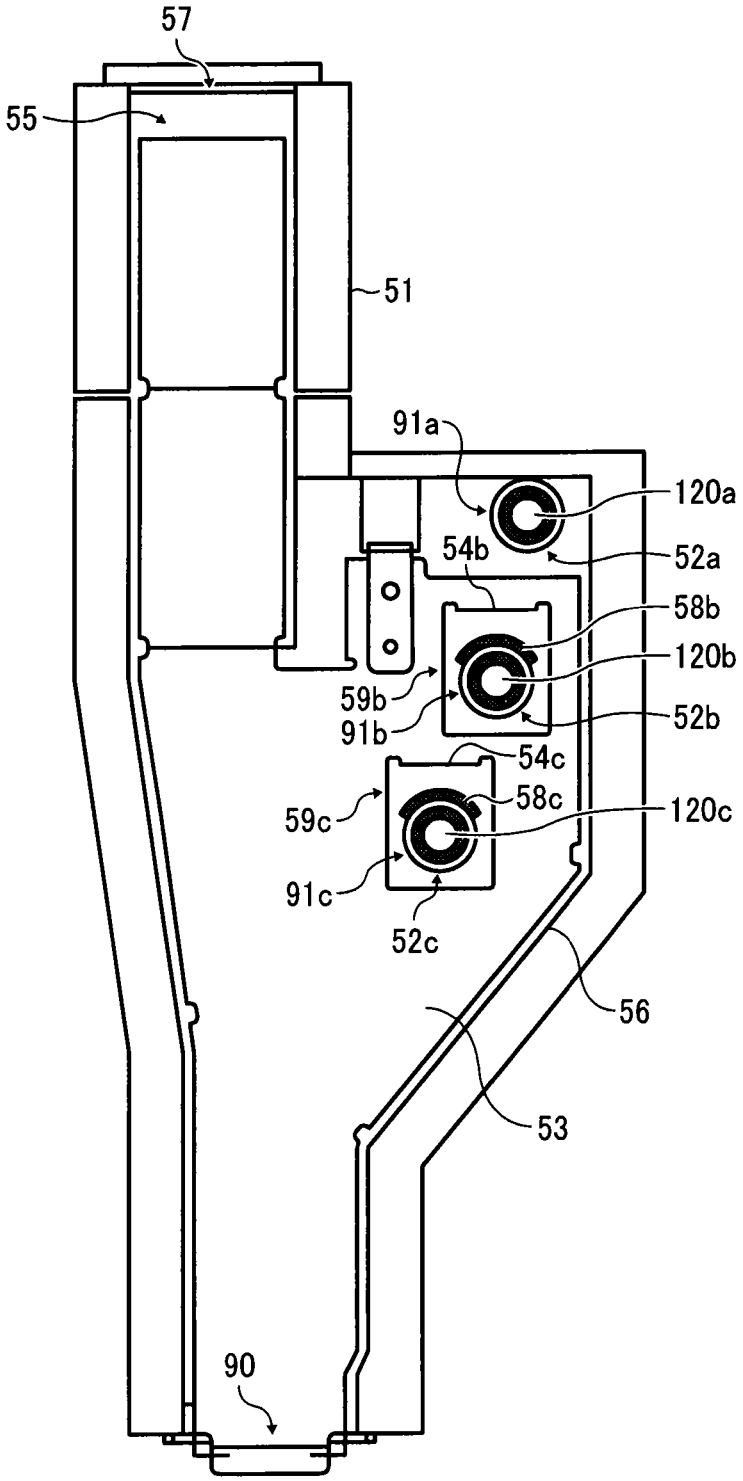
FIG. 13 is a front view of the discharged-matter transport unit.
Figure 14:
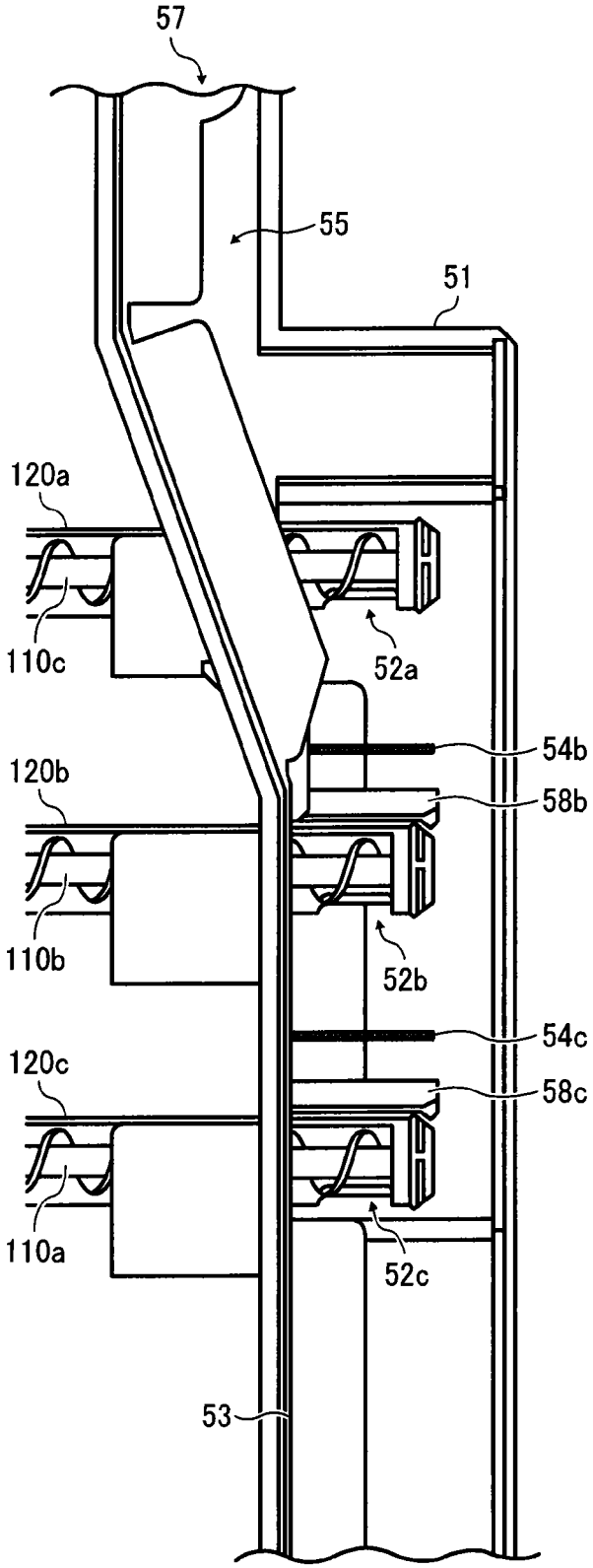
FIG. 14 is a side view of the discharged-matter transport unit shown in FIG. 13.

FIG. 13 is a front view of the discharged-matter transport unit 51 in which guards 58*b* and 58*c* that are not swung are independently disposed between the guards 54*b* and 54*c* and the toner transport pipes 120*b* and 120*c*, respectively. FIG. 14 is a side view of the discharged-matter transport unit 51.

For this reason, as shown in FIG. 13, the guards 58*b* and 58*c* that are not swung may be independently disposed between the guards 54*b* and 54*c* and the toner transport pipes 120*b* and 120*c*, respectively, such that the guards 58*b* and 58*c* are located in the through holes 59*b* and 59*c* formed in the swing plate 53 on the internal surface of the discharged-matter transport unit 51. For this reason, the guards 54*b* and 54*c* and the guards 58*b* and 58*c* doubly cover the outer circumferential surfaces of the toner transport pipes 120*b* and 120*c* to make it possible to improve the effect of preventing toner from being deposited on the outer circumferential surfaces of the toner transport pipes 120*b* and 120*c*.

The guards 58*b* and 58*c* are located under the guards 54*b* and 54*c*. Thus, toner is not easily deposited on the guards 58*b* and 58*c*. Even though the toner is deposited, a toner bridge is not formed because the deposited toner falls down when the toner is brought into contact with the lower surfaces of the swinging guards 54*b* and 54*c*.

The discharged-matter transport unit 51, as shown in FIG. 1, has the discharged-matter falling port 57 above the toner transport pipes 120*a*, 120*b*, and 120*c*. However, the toner transport pipes 120*a*, 120*b*, and 120*c* are arranged not to overlap the discharged-matter falling port 57 when viewed in the vertical direction. For this reason, toner sent from the discharged-matter dropping port 57 to the discharged-matter falling path 55 and falling through the discharged-matter falling path 55 can be suppressed from being deposited on the outer circumferential surface of the toner transport pipe 120.

As shown in FIG. 1, the discharged-matter transport unit 51 has a tilted surface 56 on the lower side of the ejection ports 52*a*, 52*b*, and 52*c* of the toner transport pipes 120*a*, 120*b*, and 120*c*. With this configuration, toner ejected from the ejection ports 52*a*, 52*b*, and 52*c* slips down on the tilted surface 56 and is guided to the downstream side of the discharged-matter falling path 55. Toner ejected from the ejection ports 52*a*, 52*b*, and 52*c* can be suppressed from being deposited on the wall surface of the discharged-matter transport unit 51 on the lower side of the ejection ports 52*a*, 52*b*, and 52*c*.

Since the tilted surface 56 is formed on the lower side of the ejection ports 52*a*, 52*b*, and 52*c*, a motor is disposed in a space under the tilted surface 56 of the discharged-matter transport unit 51 in the printer, or the space is used in an application except for the transport path to make it possible to achieve space saving as the whole apparatus.

The above descriptions relate to the toner transport from the belt cleaning device 100 that cleans the intermediate transfer belt 8. However, the same configuration as described above can be employed in a configuration of cleaning the photoconductor 1.

The above description is just an example, and an image forming apparatus according to embodiments of this disclosure can exert, for example, a particular effect in each of the following aspects.

Aspect A

An image forming apparatus includes an image carrier such as the intermediate transfer belt 8, a toner-image forming unit such as the development device 5 to form a toner image on a surface of the image carrier, a transfer unit such as secondary transfer roller 18 to transfer the toner image formed on the surface of the image carrier to a transfer material such as the recording sheet P, a cleaner such as the belt cleaning device 100 to remove toner adhering to and remaining on the surface of the image carrier after the toner image is transferred by the transfer unit, a plurality of cylindrical transport path forming members such as the toner transport pipes 120, each of which forms a transport path to transport the toner removed by the cleaner and has a first end connected to the cleaner, a falling transport path forming member such as the discharged-matter transport unit 51 having a through hole in a side wall of the falling transport path forming member, a second end of each of the plurality of transport path forming members inserted into the through hole such as the through hole 91*a*, the falling transport path forming member forming a falling transport path such as the discharged-matter falling path 55 that causes toner ejected from an ejection port such as the ejection port 52 disposed in the second end of each of the plurality of transfer path forming members to fall, and a discharge port disposed in a lower part of the falling transport path forming member to discharge the toner to a discharge destination. The second ends of the plurality of transport path forming members are disposed offset from each other in a horizontal direction on the side wall of the falling transport path forming member. In Aspect A, the second ends of the plurality of transport path forming members are disposed offset from each other in the horizontal direction on the side wall of the falling transport path forming member such that an ejection port of one of the plurality of transport path forming members is not located immediately above another of the plurality of transport path forming members. In this manner, in comparison with the case in which the second ends of the plurality of transport path forming members are arranged to be linearly arrayed in the vertical direction to locate the ejection port of one of the plurality of transport path forming members immediately above another of the plurality of transport path forming members, toner ejected from the ejection port of the one of the plurality of transport path forming members is not easily accumulated on the outer circumferential surface of the another of the plurality of transport path forming members. Such a configuration suppresses formation of a toner bridge on the falling transport path in the falling transport path forming member into which the ends of the plurality of transport path forming members are inserted.

Aspect B

In Aspect A, the second ends of the plurality of transport path forming members are disposed offset from each other in a vertical direction on the side wall of the falling transport path forming member, and a first cover such as the guard 54 that covers an outer circumferential surface of at least one of the plurality of transport path forming members is disposed above the at least one of the plurality of transport path forming members in the vertical direction in the falling transport path forming member. As described in the above-described embodiment, such a configuration enhances the effect of preventing toner from being accumulated on the outer circumferential surfaces of the plurality of transport path forming members.

Aspect C

In Aspect A or Aspect B, each shift amount of horizontal positions of the plurality of transport path forming members in the falling transport path forming member when viewed in the vertical direction is half or more a horizontal width of each of the plurality of transport path forming members. As described in the above-described embodiment, such a configuration suppresses deposition of toner ejected from the ejection port of one transport path forming member on the outer circumferential surface of another transport path forming member.

Aspect D

In Aspect A, Aspect B, or Aspect C, the falling transport path forming member has a tilted surface such as the tilted surface 56 tilted with respect to the vertical direction below the plurality of transport path forming members. As described in the above-described embodiment, such a configuration achieves space saving as the whole apparatus.

Aspect E

In Aspect A, Aspect B, Aspect C, or Aspect D, the falling transport path forming member has an opening such as the discharged-matter falling port 57 to send toner to the falling transport path forming member above the plurality of transport path forming members, and the second ends of the plurality of transport path forming members do not overlap the opening when viewed in the vertical direction. For such a configuration, as described in the above-described embodiment, toner sent from the opening to the falling transport path can be suppressed from being accumulated on the outer circumferential surface of the transport path forming member.

Aspect F

In Aspect A, Aspect B, Aspect C, Aspect D, or Aspect E, a toner bridge preventing member such as the swing plate 53 that moves in the falling transport path to prevent a toner bridge from being formed is disposed, and the first cover is disposed on the toner bridge preventing member. For such a configuration, as described in the above-described embodiment, the first cover also moves in interlocking with movement of the toner bridge preventing member to make it possible to remove toner accumulated on the first cover.

Aspect G

In Aspect F, a second cover such as the guard 58 different from the first cover is disposed between the first cover and the at least one of the plurality of transport path forming members. For such a configuration, as described in the above-described embodiment, the outer circumferential surfaces of the transport path forming members are doubly covered with the two covers to improve the effect of preventing toner from being accumulated on the outer circumferential surfaces of the transport path forming members.

Aspect H

In Aspect F or Aspect G, the toner bridge preventing member is a plate-like member, a periphery of a through hole forming portion of the plate member that forms a through hole such as the through hole 59 to cause the through hole to correspond to the second end of each of the plurality of transport path forming members is cut out such that an upper side of a wall surface of the through hole forming portion and a wall surface near the through hole forming portion are continuously connected to each other, a portion of the through hole forming portion of the plate member of the through hole forming portion is bent to form the through hole, and the bent portion of the through hole forming portion is used as the first cover. For such a configuration, as described in the above-described embodiment, the first cover need not be attached to the toner bridge preventing member as an independent part to make it possible to reduce the cost.

Aspect I

In Aspect A, Aspect B, Aspect C, Aspect D, Aspect E, Aspect F, Aspect G, or Aspect H, the cleaner includes three cleaning brushes that remove toner on the image carrier, and has a regularly-charged toner cleaning brush such as the regularly-charged toner cleaning brush roller 107 that is applied with a voltage of a polarity opposite a regular charging polarity of toner to electrostatically remove toner of the regular charging property on the image carrier, a reversely-charged toner cleaning brush such as the reversely-charged toner cleaning brush roller 104 that is disposed on an upstream side of the regularly-charged toner cleaning brush with reference to a surface moving direction of the image carrier and is applied with a voltage of the same polarity as the regular charging polarity of toner to electrostatically remove toner of a polarity opposite the regular charging polarity on the image carrier, and a pre-cleaning brush such as the pre-cleaning brush roller 101 that is disposed on an upstream side of the regularly-charged toner cleaning brush and the reversely-charged toner cleaning brush with reference to the surface moving direction of the image carrier and is applied with a voltage of a polarity opposite the regular charging polarity of toner to electrostatically remove toner of the regular charging polarity on the image carrier. According to this, as described in the above-described embodiment, three cleaners are used and applied with different voltages, respectively, to make it possible to preferably remove toner from the image carrier.

Numerous additional modifications and variations are possible in light of the above teachings. It is therefore to be understood that, within the scope of the above teachings, the present disclosure may be practiced otherwise than as specifically described herein. With some embodiments having thus been described, it will be obvious that the same may be varied in many ways. Such variations are not to be regarded as a departure from the scope of the present disclosure and appended claims, and all such modifications are intended to be included within the scope of the present disclosure and appended claims.

What is claimed is:

1. An image forming apparatus, comprising:

an image carrier;

a toner-image forming unit to form a toner image on a surface of the image carrier;

a transfer unit to transfer the toner image formed on the surface of the image carrier to a transfer material;

a cleaner to remove toner adhering to and remaining on the surface of the image carrier after the toner image is transferred by the transfer unit;

a plurality of cylindrical transport path forming members, each of which forms a transport path to transport the toner removed by the cleaner and has a first end connected to the cleaner;

a falling transport path forming member having through holes in a side wall of the falling transport path forming member, a second end of each of the plurality of transport path forming members inserted into a corresponding one of the through holes, the falling transport path forming member forming a falling transport path that causes toner ejected from an ejection port disposed in the second end of each of the plurality of transport path forming members to fall;

and a discharge port disposed in a lower part of the falling transport path forming member to discharge the toner to a discharge destination, wherein the second ends of the plurality of transport path forming members are disposed offset from each other in a horizontal direction and in a vertical direction on the side wall of the falling transport path forming member, wherein an extended portion of the second end of at least one of the plurality of transport path forming members extends beyond the side wall, wherein the extended portion includes the ejection port of the at least one of the plurality of transport path forming members, and wherein a first cover that covers an outer circumferential surface of the extended portion of the at least one of the plurality of transport path forming members is disposed above the extended portion of the at least one of the plurality of transport path forming members and below another transport path forming member of the plurality of transport path forming members in the vertical direction in the falling transport path forming member.

2. The image forming apparatus according to claim 1, further comprising:

a toner bridge preventing member that moves in the falling transport path to prevent a toner bridge from being formed, wherein the first cover is disposed on the toner bridge preventing member.

3. The image forming apparatus according to claim 2, further comprising a second cover different from the first cover, wherein the second cover is disposed between the first cover and the at least one of the plurality of transport path forming members.

4. The image forming apparatus according to claim 2, wherein the toner bridge preventing member is a plate member, a periphery of a through hole forming portion of the plate member in which a through hole is disposed corresponding to the second end of each of the plurality of transport path forming members is cut out such that an upper side of a wall surface of the through hole forming portion and a wall surface near the through hole forming portion are continuously connected to each other, a portion of the through hole forming portion of the plate member is bent to form the through hole, and the bent portion of the through hole forming portion is used as the first cover.

5. The image forming apparatus according to claim 1, wherein each shift amount of horizontal positions of the plurality of transport path forming members in the falling transport path forming member when viewed in the vertical direction is half or more a horizontal width of each of the plurality of transport path forming members.

6. The image forming apparatus according to claim 1, wherein the falling transport path forming member has a tilted surface tilted with respect to the vertical direction below the plurality of transport path forming members.

7. The image forming apparatus according to claim 1, wherein the falling transport path forming member has an opening to send toner to the falling transport path forming member above the plurality of transport path forming members, and the second ends of the plurality of transport path forming members do not overlap the opening when viewed in the vertical direction.

8. The image forming apparatus according to claim 1, wherein the cleaner includes three cleaning brushes that remove toner on the image carrier and has a regularly-charged toner cleaning brush that is applied with a voltage of a polarity opposite a regular charging polarity of toner to electrostatically remove toner of the regular charging polarity on the image carrier, a reversely-charged toner cleaning brush that is disposed on an upstream side of the regularly-charged toner cleaning brush with reference to a surface moving direction of the image carrier and is applied with a voltage of the same polarity as the regular charging polarity of toner to electrostatically remove toner of a polarity opposite the regular charging polarity on the image carrier, and a pre-cleaning brush that is disposed on an upstream side of the regularly-charged toner cleaning brush and the reversely-charged toner cleaning brush with reference to the surface moving direction of the image carrier and is applied with a voltage of a polarity opposite the regular charging polarity of toner to electrostatically remove toner of the regular charging polarity on the image carrier.

9. An image forming apparatus, comprising:

an image carrier;

a toner-image forming unit to form a toner image on a surface of the image carrier;

a transfer unit to transfer the toner image formed on the surface of the image carrier to a transfer material;

a cleaner to remove toner adhering to and remaining on the surface of the image carrier after the toner image is transferred by the transfer unit;

a plurality of cylindrical transport path forming members, each of which forms a transport path to transport the toner removed by the cleaner and has a first end connected to the cleaner;

a falling transport path forming member having through holes in a side wall of the falling transport path forming member, a second end of each of the plurality of transport path forming members inserted into a corresponding one of the through holes, the falling transport path forming member forming a falling transport path that causes toner ejected from an ejection port disposed in the second end of each of the plurality of transport path forming members to fall; and a discharge port disposed in a lower part of the falling transport path forming member to discharge the toner to a discharge destination; and a toner bridge preventing member that moves in the falling transport path to prevent a toner bridge from being formed, wherein the second ends of the plurality of transport path forming members are disposed offset from each other in a horizontal direction on the side wall of the falling transport path forming member.

10. The image forming apparatus according to claim 9, wherein the second ends of the plurality of transport path forming members are disposed offset from each other in a vertical direction on the side wall of the falling transport path forming member, and a first cover that covers an outer circumferential surface of at least one of the plurality of transport path forming members is disposed above the at least one of the plurality of transport path forming members in the vertical direction in the falling transport path forming member.

11. The image forming apparatus according to claim 10, wherein the first cover is disposed on the toner bridge preventing member.

12. The image forming apparatus according to claim 11, further comprising a second cover different from the first cover, wherein the second cover is disposed between the first cover and the at least one of the plurality of transport path forming members.

13. The image forming apparatus according to claim 11, wherein the toner bridge preventing member is a plate member, a periphery of a through hole forming portion of the plate member in which a through hole is disposed corresponding to the second end of each of the plurality of transport path forming members is cut out such that an upper side of a wall surface of the through hole forming portion and a wall surface near the through hole forming portion are continuously connected to each other, a portion of the through hole forming portion of the plate member is bent to form the through hole, and the bent portion of the through hole forming portion is used as the first cover.

14. The image forming apparatus according to claim 9, wherein each shift amount of horizontal positions of the plurality of transport path forming members in the falling transport path forming member when viewed in the vertical direction is half or more a horizontal width of each of the plurality of transport path forming members.

15. The image forming apparatus according to claim 9, wherein the falling transport path forming member has a tilted surface tilted with respect to the vertical direction below the plurality of transport path forming members.

16. The image forming apparatus according to claim 9, wherein the falling transport path forming member has an opening to send toner to the falling transport path forming member above the plurality of transport path forming members, and the second ends of the plurality of transport path forming members do not overlap the opening when viewed in the vertical direction.

17. The image forming apparatus according to claim 9, wherein the cleaner includes three cleaning brushes that remove toner on the image carrier and has a regularly-charged toner cleaning brush that is applied with a voltage of a polarity opposite a regular charging polarity of toner to electrostatically remove toner of the regular charging polarity on the image carrier, a reversely-charged toner cleaning brush that is disposed on an upstream side of the regularly-charged toner cleaning brush with reference to a surface moving direction of the image carrier and is applied with a voltage of the same polarity as the regular charging polarity of toner to electrostatically remove toner of a polarity opposite the regular charging polarity on the image carrier, and a pre-cleaning brush that is disposed on an upstream side of the regularly-charged toner cleaning brush and the reversely-charged toner cleaning brush with reference to the surface moving direction of the image carrier and is applied with a voltage of a polarity opposite the regular charging polarity of toner to electrostatically remove toner of the regular charging polarity on the image carrier.

18. An image forming apparatus, comprising:

an image carrier;

a toner-image forming unit to form a toner image on a surface of the image carrier;

a transfer unit to transfer the toner image formed on the surface of the image carrier to a transfer material;

a cleaner to remove toner adhering to and remaining on the surface of the image carrier after the toner image is transferred by the transfer unit;

a plurality of cylindrical transport path forming members, each of which forms a transport path to transport the toner removed by the cleaner and has a first end connected to the cleaner;

a falling transport path forming member having through holes in a side wall of the falling transport path forming member, a second end of each of the plurality of transport path forming members inserted into a corresponding one of the through holes, the falling transport path forming member forming a falling transport path that causes toner ejected from an ejection port disposed in the second end of each of the plurality of transport path forming members to fall; and a discharge port disposed in a lower part of the falling transport path forming member to discharge the toner to a discharge destination, wherein the second ends of the plurality of transport path forming members are disposed offset from each other in a horizontal direction on the side wall of the falling transport path forming member, and wherein the falling transport path forming member has an opening to send toner to the falling transport path forming member above the plurality of transport path forming members, and the second ends of the plurality of transport path forming members do not overlap the opening when viewed in the vertical direction.

* * * * *